US007528309B2

(12) United States Patent
Fujiwara

(10) Patent No.: US 7,528,309 B2
(45) Date of Patent: May 5, 2009

(54) AUTOMATIC PLAYER MUSICAL INSTRUMENTS AND AUTOMATIC PLAYING SYSTEM INCORPORATED THEREIN

(75) Inventor: Yuji Fujiwara, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 111 days.

(21) Appl. No.: 11/681,308

(22) Filed: Mar. 2, 2007

(65) Prior Publication Data

US 2007/0221036 A1 Sep. 27, 2007

(30) Foreign Application Priority Data

Mar. 27, 2006 (JP) ..... 2006-085258

(51) Int. Cl.
*G10F 1/02* (2006.01)
*G10F 3/00* (2006.01)

(52) U.S. Cl. ..... 84/21; 84/13; 84/20; 84/615; 84/645; 84/658; 84/719; 84/726; 84/723; 84/743; 84/744

(58) Field of Classification Search ..... 84/13, 84/20, 21
See application file for complete search history.

(56) References Cited

U.S. PATENT DOCUMENTS 5,654,517 A * 8/1997 Miyamoto ..... 84/609
5,691,489 A * 11/1997 Fujiwara et al. ..... 84/21
5,731,530 A * 3/1998 Fujiwara et al. ..... 84/21
5,739,450 A * 4/1998 Fujiwara et al. ..... 84/462
6,359,207 B1 * 3/2002 Oba et al. ..... 84/658
7,217,880 B2 * 5/2007 Sant ..... 84/645
7,288,712 B2 * 10/2007 Uehara ..... 84/645
7,348,482 B2 * 3/2008 Ishii et al. ..... 84/616
7,361,828 B2 * 4/2008 Sasaki ..... 84/743
7,381,880 B2 * 6/2008 Fujiwara et al. ..... 84/615
7,420,116 B2 * 9/2008 Fujiwara ..... 84/619
2005/0092164 A1 * 5/2005 Fujiwara et al. ..... 84/645
2006/0090633 A1 * 5/2006 Muramatsu ..... 84/723
2006/0185503 A1 * 8/2006 Fujiwara ..... 84/626
2007/0169608 A1 * 7/2007 Fujiwara ..... 84/13
2007/0221036 A1 * 9/2007 Fujiwara ..... 84/21

OTHER PUBLICATIONS

Davies, Paul, "The Indispensable Guide to C," © 1995, Addison-Wesley, Workingham, England.*
Tutorial on MIDI and Music Synthesis, © 1995, MIDI Manufacturers Association, viewed Aug. 14, 2007 at www.harmony-central.com/MIDI/Doc/tutorial.html.*

* cited by examiner

*Primary Examiner*—Walter Benson
*Assistant Examiner*—Robert W Horn
(74) *Attorney, Agent, or Firm*—Harness, Dickey & Pierce, PLC

(57) ABSTRACT

While an automatic player piano is reenacting a music tune, the automatic player piano sometimes fails to miss a tone or tones in a repetition due to a high-speed key movement; a controller searches a music data file for a series of key events expressing the repetition, and makes the key movements uniform without changing the lapse of time from the last key event before the repetition and the lapse of time to the first key event after the repetition so that the automatic player piano is less liable to miss a tone.

20 Claims, 17 Drawing Sheets

AUTOMATIC PLAYER MUSICAL INSTRUMENTS AND AUTOMATIC PLAYING SYSTEM INCORPORATED THEREIN

FIELD OF THE INVENTION

This invention relates to an automatic player musical instrument and, more particularly, to an automatic player musical instrument callable of reproducing tones through half-stroke keys and an automatic playing system forming a part of the automatic player musical instrument.

DESCRIPTION OF THE RELATED ART

In the following description, term "front" is indicative of a position closer to a player, who sits on a stool for fingering, than a position modified with term "rear". A line drawn between a front point and a corresponding rear point extends in a "fore-and-aft direction", and a lateral direction crosses the fore-and-aft direction at right angle.

Term "trajectory" means a series of values of a point varied together with time. When a key trajectory is modified with term "forward", the key trajectory, i.e., "forward key trajectory" expresses a series of values of key position in the key movement in the downward direction toward the end position. On the other hand, term "backward key trajectory" expresses a series of values of key position in the key movement in the upward direction toward the rest position.

Term "full-stroke" is a pianistic technique for moving a key between the rest position and the end position, and term "half-stroke" is another pianistic technique in which a pianist changes the direction of key movement on the way to the rest position or end position.

An automatic player piano is a typical example of the automatic playing musical instrument, and is a combination between an acoustic piano and an automatic playing system. The automatic playing system includes solenoid-operated key actuators provided under the rear portions of black and white keys and a controlling unit, and the controlling unit has a data processing capability. Music data codes, which are defined in accordance with the MIDI (Musical Instrument Digital Interface) protocols, are sequentially processed by the controlling unit, and reference key trajectories are determined for each of the black and white keys to be moved for producing piano tones. The controlling unit supplies driving signals to the solenoid-operated key actuators associated with the black and white keys to be moved, and forces the black and white keys to travel on the reference key trajectories by means of the solenoid-operated key actuators.

Since pianists produce the piano tones through the half-stroke as well as the full-stroke in their performances, the automatic playing system is expected to reproduce both of the half-stroke and full-stroke. If an automatic playing system can not reproduce the half-stroke, the user feels the playback false. Thus, the reproduction of half-stroke is an important factor in the playback through the automatic playing system.

A prior art half-stroke reproducing technique is disclosed in Japan Patent No. 3541411. In the prior art half-stroke reproducing technique, the controlling unit analyzes a music data code expressing a note-on event of a key and a music data code expressing a note-off event of the key to see whether or not the forward key trajectory crosses the backward key trajectory before the end position. When the answer is given affirmative, the controlling unit determines that the piano tone is to be produced through the half-stroke.

A pianist repeats the half-stroke in repetition of a key. In case where a pianistrepeats the half-stroke at high speed, an automatic playing system can not reproduce the high-speed repetition, and a tone or tones are liable to be missing. A countermeasure is proposed in Japan Patent No. 3551507. The music data code for the note-on event has a piece of music data expressing the key velocity, and the music data codes for the note-on events and note-off events are accompanied with duration data codes expressing the lapse of time from the previous events. In the prior art automatic playing system disclosed in Japan Patent No. 3551507, when the controlling unit finds the music data codes for the repetition, the controlling unit increases the key velocity or shortens the lapse of time. Thus, the prior art controlling unit prevents the playback from a missing tone or tones in the repetition by accelerating the key or making the time intervals short.

However, a missing tone or tones take place due to another cause. It is well known to music fans that plural types of pianos have been designed. Upright pianos and grand pianos are typical examples of different types of pianos. Differences between the upright pianos and the grand pianos are by no means limited to the external appearance. The upright pianos have action units different in structure from the action units of grand pianos, and the action units of grand pianos are usually responsive to high-speed repetition rather than the action units of upright pianos are. It is said that the action units of upright pianos can drive the hammers at 8 Hz. On the other hand, the action units of grand pianos are well responsive to the repetition at 13 Hz. Moreover, the upright pianos have different models, and the grand pianos also have different models. A model of upright piano or grand piano is equipped with the action units different from those of another model.

In this situation, a player is assumed to record his or her performance on a grand piano in a set of music data codes. The set of music data codes may be loaded in a controlling unit incorporated in an automatic player upright piano for playback. If a high-speed passage is incorporated in the original performance on the grand piano, there is a possibility that a missing tone or tones take place in the playback due to the poor promptness of the action units incorporated in the upright piano.

The missing tone or tones may take place due to yet another cause. Many musicians compose music tunes on their personal computer systems with the assistance of a computer program. It is possible for the musicians to insert extremely high-speed passages in their music tunes. If a user obtains the set of music data codes for playback on an automatic player upright piano, the automatic playing system may not reproduce the extremely high-speed passage due to the poor promptness of the action units.

The difference between the recording system and the playback system is not taken into account for the prior art automatic player piano disclosed in Japan Patent No. 3541411.

Although there is found description on the difference in the type of pianos in the Japanese Patent, the users feel the music tune reproduced through the automatic playing strange. This is because of the fact that the pieces of music data, which express the original tones, are modified for the reproduced tones in the high-speed repetition. Thus, the prior art automatic player pianos disclosed in the Japan Patents can not overcome the problems due to the difference in the response characteristics of the action units.

SUMMARY OF THE INVENTION

It is therefore an important object of the present invention to provide an automatic player musical instrument, which reproduces a music passage at high fidelity regardless of the response characteristics of the musical instruments.

It is another important object of the present invention to provide an automatic playing system, which forms the part of the automatic player musical instrument.

The inventor contemplated the problem inherent in the prior art, and noticed that the missing tone tended to take place at the abrupt change of the key movement. The inventor investigated the key movements in the repetition, and found that the key was moved on a part of the key trajectory at high-speed and on another part at low-speed. In short, the key did not uniformly travel on the key trajectory. Even though the frequency of key-on events was fallen within the range lower than the critical frequency of the model of actions, the action unit could not drive the hammer on the condition that the associated key was rapidly accelerated, and the tone was missing. The inventor thought that the uniformity of key movements in repetition was effective against the missing tone.

To accomplish the object, the present invention proposes to make at least key-on events uniform in repetition.

In accordance with one aspect of the present invention, there is provided an automatic player musical instrument for producing tones along a music passage having a repetition comprising a musical instrument including plural manipulators selectively moved for specifying the tones to be produced and a tone generator connected to the plural manipulators and producing the tones specified by means of the manipulators moved for the tones, and an automatic playing system including plural actuators provided in association with the plural manipulators and responsive to a driving signal so as to move the associated manipulators for specifying the tones and a controlling unit connected to the plural actuators for selectively supplying the driving signal to the plural actuators and including a searcher searching a set of pieces of music data expressing a music passage for tone producing events expressing at least one repetition on one of the plural manipulators, a modifier connected to the searcher and modifying pieces of event data expressing properties of the tone producing events so as to make at least one of the properties of the tone producing events uniform and a signal regulator connected to the modifier and regulating the driving signal to an optimum magnitude on the basis of the pieces of event data so as to cause the tone generator to produce the tones through the movements of the manipulators on the condition that aforesaid at least one of the properties of the tone producing events is uniform.

In accordance with another aspect of the present invention, there is provided an automatic playing system for performing a music passage on a musical instrument comprising plural actuators provided in association with plural manipulators of the musical instrument and responsive to a driving signal so as to move the associated manipulators for specifying tones to be produced by means of a tone generator of the musical instrument connected to the plural manipulators, and a controlling unit connected to the plural actuators for selectively supplying the driving signal to the plural actuators and including a searcher searching a set of pieces of music data expressing a music passage for tone producing events expressing at least one repetition on one of the plural manipulators, a modifier connected to the searcher and modifying pieces of event data expressing properties of the tone producing events so as to make at least one of the properties of the tone producing events uniform and a signal regulator connected to the modifier and regulating the driving signal to an optimum magnitude on the basis of the pieces of event data so as to cause the tone generator to produce the tones through the movements of the manipulators on the condition that aforesaid at least one of the properties of the tone producing events is uniform.

BRIEF DESCRIPTION OF THE DRAWINGS

The features and advantages of the automatic player musical instrument and automatic playing system will be more clearly understood from the following description taken in conjunction with the accompanying drawings, in which

FIG. 11 is a block diagram showing a servo control loop formed in the automatic player piano.

DESCRIPTION OF THE PREFERRED EMBODIMENTS

Figure 1:
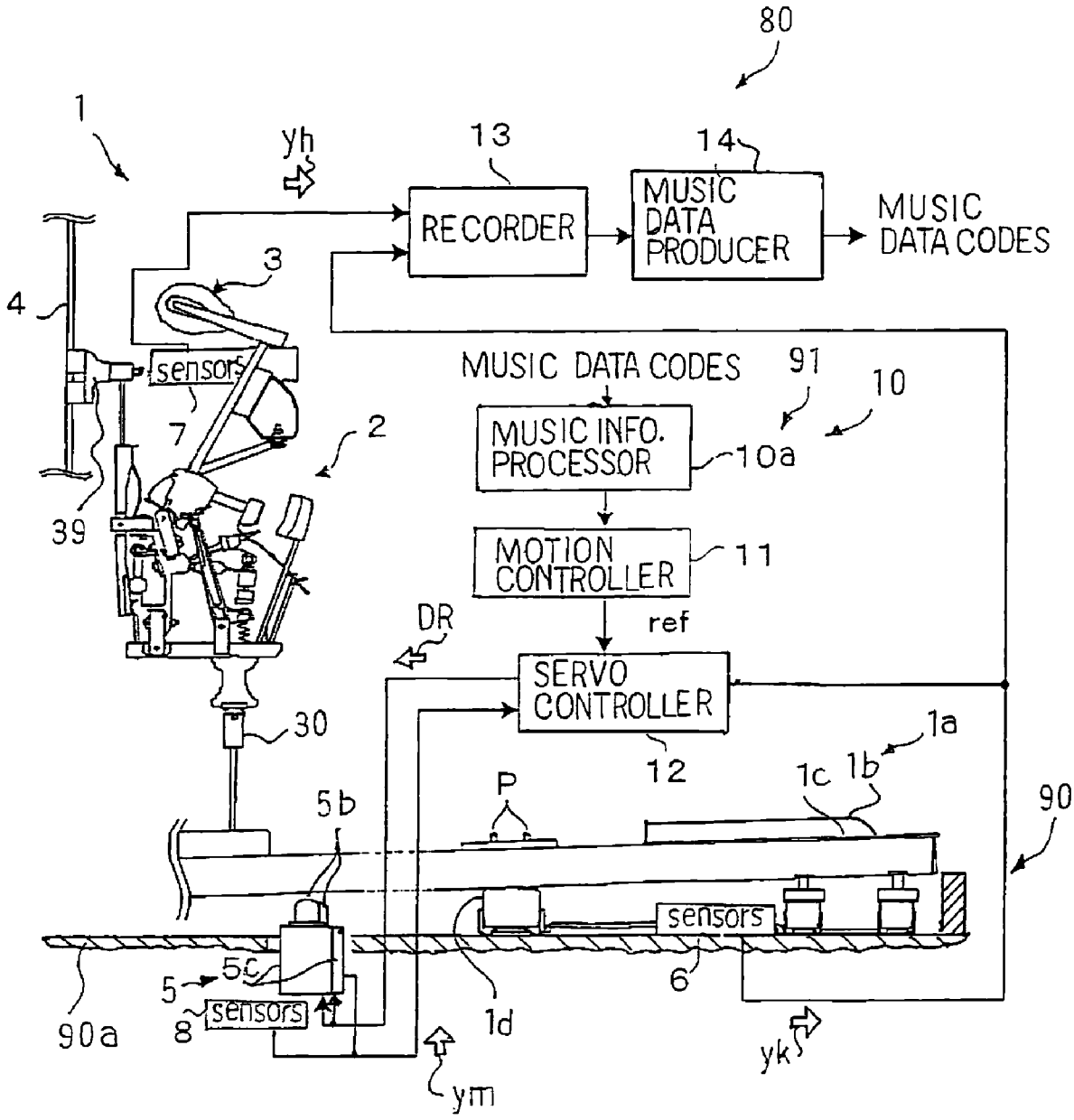
FIG. 1 is a schematic side view showing the structure of an automatic player piano according to the present invention.

An automatic player musical instrument embodying the present invention produces tones along a music passage without any fingering of a human player. The music passage includes a repetition. The automatic player musical instrument largely comprises a musical instrument and an automatic playing system. The automatic playing system is combined with the musical instrument, and performs a music passage on the musical instrument.

The musical instrument includes plural manipulators and a tone generator, and the plural manipulators are connected to the tone generator. The plural manipulators are selectively moved for specifying the tones to be produced, and the moved manipulators causes the tone generator to produce the tones.

The automatic playing system includes plural actuators and a controlling unit. The plural actuators are provided in association with the plural manipulators, and are responsive to a driving signal so as to move the associated manipulators for specifying the tones. The controlling unit is connected to the plural actuators, and selectively supplies the driving signal to the plural actuators for a performance without any fingering of a human player.

The controlling unit has functions, which are called as a searcher, a modifier and a signal regulator. The searcher, modifier and signal regulator may be implemented by software. Otherwise, the searcher, modifier and signal generator are implemented by hardware such as, for example wired-logic circuits.

The searcher searches a set of pieces of music data expressing a music passage for tone producing events expressing at least one repetition on one of the plural manipulators. In case where the set of pieces of music data are stored in a set of MIDI (Musical Instrument Digital Interface) music data codes, the tone producing events are called as key-on events and key-off events, and the searcher extracts MIDI music data codes expressing tones repeatedly produced from the set of MIDI music data codes.

The modifier is connected to the searcher so that the searcher informs the modifier of the tone producing events expressing the repetition. The tone producing events are usually not uniform. A tone producing event may quickly take place rather than the other tone producing events. Otherwise, a tone may be produced at large loudness in another tone producing event. Thus, each of the tone producing events has various properties. The properties to tone producing events are expressed by pieces of event data. In this situation, the modifier modifies the pieces of event data so as to make at least one of the properties of the tone producing events uniform. The property to be modified may be the lapse of time between each tone producing event and the next tone producing event, velocity of the manipulator increment or decrement of the velocity, stroke of the manipulator, or increment or decrement of the stroke, The signal regulator is connected to the modifier, and the modifier supplies the pieces of event data to the signal regulator. The signal regulator regulates the driving signal to an optimum magnitude on the basis of the pieces of event data so that the actuators drives the manipulators in such a manner that the manipulators cause the tone generator to produce the tones on the condition that the tone producing events exhibits the uniform property.

As will be appreciated from the foregoing description, even though an abrupt change of the property takes place in the repetition, the abrupt change is made uniform or mild. As a result, the automatic playing system moves the manipulator during the repetition without a missing tone.

First Embodiment

Referring first to FIG. 1 of the drawings, an automatic player piano embodying the present invention largely comprises an upright piano 1, an automatic playing system 10 and a recording system 80. A human player fingers a piece of music on the upright piano 1, and acoustic piano tones are produced along the music passage in the upright piano 1. The automatic playing system 10 and recording system 80 are installed in the upright piano 1. An original performance on the upright piano 1 is recorded through the recording system 80, and the automatic playing system 10 reenacts a performance on the upright piano 1 on the basis of pieces of music data. The pieces of music data are produced through the recording system 80. Otherwise, the pieces of music data may express a performance on a grand piano, or may be produced on a personal computer system with a suitable computer program. In this instance, the pieces of music data are coded in accordance with the MIDI protocols.

The upright piano 1 includes a keyboard 1*a* having black keys 1*b* and white keys 1*c*, action units 2, hammers 3, strings 4, dampers 39 and a piano cabinet 90. An inner space is defined in the piano cabinet 90, and the action units 2, hammers 3, dampers 39 and strings 4 occupy the inner space. A key bed 90*a* forms a part of the piano cabinet 90, and the keyboard 1*a* is mounted on the key bed 90*a*. In this instance, the keyboard 1*a* has eighty-eight black and white keys 1*b*/1*c*.

The black keys 1*b* and white keys 1*c* are laid on the well-known pattern, and extend in parallel to the fore-and-aft direction. Pitch names are respectively assigned to the black keys 1*b* and white keys 1*c*. Balance key pins P offer fulcrums to the black keys 1*b* and white keys 1*c* on a balance rail 1*d*. Capstan buttons 30 are upright on the rear portions of the black keys 1*b* and the rear portions of the white keys 1*c*, and are held in contact with the action units 2. Thus, the black keys 1*b* and white keys 1*c* are respectively linked with the action units 2 so as to actuate the action units 2 during travels from rest positions toward end positions. While any force is not being exerted on the front portions of black keys 1*b* and the front portions of white keys 1*c*, the weight of action units 2 are being exerted on the rear portions of black keys 1*b* and the rear portions of which keys 1*c*, and the black keys 1*b* and white keys 1*c* stay at the rest positions. The keystroke at the rest positions is zero. While a human player is depressing the front portions of black keys 1*b* and the front portions of white keys 1*c*, the front portions are sunk, and the black keys 1*b* and white keys 1*c* travel from the rest positions toward the end positions. In this instance, when the black keys 1*b* and white keys 1*c* are found at the rest positions, the keystroke is zero. The end positions are spaced from the rest positions by 10 millimeters.

The action units 2 are provided in association with the hammers 3 and dampers 39, and the actuated action units 2 drive the associated hammers 3 and dampers 39 for rotation.

The strings 4 are stretched inside the piano cabinet 90, and the hammers 3 are respectively opposed to the strings 4. The dampers 39 are spaced from and brought into contact with the strings 4 depending upon the key position. While the black keys 1*b* and white keys 1*c* are staying at the rest positions, the dampers 39 are held in contact with the strings 4, and the hammers 3 are spaced from the strings 4.

When the black keys 1*b* and white keys 1*c* reach certain points on the way toward the end positions, the dampers 39 leave the strings 4 and are spaced from the strings 4. As a result, the dampers 39 permit the strings 4 to vibrate.

The action units 2 give rise to rotation of hammers 3 during the key movements toward the end positions, and escape from the associated hammers 3 through escape. Then, the hammers 3 start rotation, and are brought into collision with the associated strings 4 at the end of the rotation. The hammers 3 rebound on the associated strings 4. Thus, the hammers 3 give rise to vibrations of the associated strings 4. The acoustic piano tones are produced through the vibrations of the strings 4 at the pitch names identical with those assigned to the associated black and white keys 1*b*/1*c*.

When the human player releases the black keys 1*b* and white keys 1*c*, the black keys 1*b* and white keys 1*c* start to return toward the rest positions. The dampers 39 are brought into contact with the vibrating strings 4 on the way of keys 1*b*/1*c* toward the rest positions, and prohibit the strings 4 from the vibrations. As a result, the acoustic piano tones are decayed.

The automatic playing system 10 includes solenoid-operated key actuators 5 with built-in plunger sensors 8, key sensors 6, a music information processor 10*a*, a motion controller 11 and a servo controller 12. The music information processor 10*a*, motion controller 11 and servo controller 12 stand for functions, which are realized through execution of a subroutine program of a computer program running on a controlling unit 91.

A slot 90*b* is formed in the key bed 90*a* below the rear portions of the black and white keys 1*b* and 1*c*, and extends in the lateral direction. The solenoid-operated key actuators 5 are arrayed inside the slot 90*b*, and each of the solenoid-operated key actuators 5 has a plunger 5*b* and a solenoid 5*c*. The solenoids 5*c* are connected in parallel to the servo controller 12, and are selectively energized with the driving signal DR so as to create respective magnetic fields. The plungers 5*b* are provided in the magnetic fields so that the magnetic force is exerted on the plungers 5*b*. The magnetic force causes the plungers 5*b* to project in the upward direction, and the rear portions of the black and white keys 1*b* and 1*c* are pushed with the plungers 5*b* of the associated solenoid-operated key actuators 5. As a result, the black and white keys 1*b* and 1*c* pitch up and down without any fingering of a human player.

The built-in plunger sensors 8 respectively monitor the plungers 5*b*, and supply plunger velocity signals ym representative of plunger velocity to the servo controller 12.

The key sensors 6 are provided below the front portions of the black and white keys 1*b*/1*c*, and monitor the black and white keys 1*b*/1*c*, respectively. In this instance, an optical position transducer is used as the key sensors 6. Plural light-emitting diodes, plural light-detecting diodes, optical fibers and sensor heads form in combination the array of key sensors 6. Each of the sensor heads is opposed to the adjacent sensor heads, and the black/white keys 1*b*/1*c* adjacent to one another are moved in gaps between the sensor heads. Light is propagated from the light-emitting diodes through the optical fibers to selected ones of sensor heads, and light beams are radiated from these sensor heads to the adjacent sensor heads. The light beams are fallen onto the adjacent sensor heads, and the incident light is propagated from the adjacent sensor heads to the light-detecting diodes. The incident light is converted to photo current. Since the black keys 1*b* and white keys 1*c* interrupt the light beams, the amount of incident light is varied depending upon the key positions. The photo current is converted to potential level through the light-detecting diodes so that the key sensors 6 output key position signals yk representative of the key positions. The key sensors 6 have a detectable range as wide as or wider than the full keystroke, i.e. from the rest positions to the end positions. The key sensors 6 supply the key position signals yk representative of current key position of the associated black and white keys 1*b*/1*c* to the servo controller 12 and the recording system 80. Pieces of position data, which express the current key positions, are used in the servo control sequence as will be hereinlater described. The pieces of position data are analyzed in the recording system 80 for producing pieces of music data expressing a performance on the upright piano 10.

A performance is expressed by pieces of music data, and the pieces of music data are given to the music information processor 10*a* in the form of music data codes. In this instance, the pieces of music data are coded into music data codes in accordance with the MIDI protocols. A key movement toward the end position and a key movement toward the rest position are respectively referred to as a key-on event and a key-off event, and term "key event" means both of the key-on and key-off events.

The pieces of music data are sequentially supplied to the music information processor 10*a*. A series of values of target key position forms the reference trajectory as described hereinbefore, and the target key position is varied with time. A reference point is found on the reference key trajectory. The hammer 3 is brought into collision with the string 4 at the target hammer velocity at the end of the rotation in so far as the associated black key 1*b* or associated white key 1*c* passes through the reference point.

Music data codes, which express a performance, are supplied from a suitable information storage medium or another musical instrument to the music information processor 10*a* through a MIDI cable or a public communication network. The music information processor 10*a* firstly normalizes the pieces of music data, and converts the units used in the MIDI protocols to a system of units employed in the automatic player piano. In this instance, position, velocity and acceleration are expressed in millimeter-second system of units. Thus, pieces of playback data are produced from the pieces of music data through the music information processor 10*a*.

The music information processor 10*a* checks the pieces of music data to see whether or not a black key 1*b* or white key 1*c* is to be driven for repetition. When the answer is given affirmative, the music information processor 10*a* processes the pieces of music data for the repetition as will be described hereinlater in detail. The key events for the repetition form a group of key event to be concurrently process in accordance with the present invention.

The motion controller 11 determines a reference key trajectory ref for each of the black keys 1*b* and white keys 1*c* to be depressed and released in the playback. In other words, the motion controller 11 produces pieces of reference key trajectory data on the basis of the pieces of playback data. As described hereinbefore, the reference key trajectory ref expresses a series of values of key position in terms of time. Therefore, the reference key trajectory ref indicates the time at which the black key 1*b* or white key 1*c* starts to travel thereon. The pieces of reference key trajectory data are supplied from the motion controller 11 to the servo controller 12.

The servo controller 12 determines the amount of mean current of the driving signal DR. In this instance, the pulse width modulation is employed in the servo controller 12 so that the amount of mean current is varied with the time period in the active level of the driving signal. The servo controller 12 supplies the driving signal DR to the solenoid-operated actuator 5 associated with the black key 1*b* or white key 1*c* to be moved on the reference key trajectory ref, and forces the black key 1*b* or white key 1*c* to travel on the reference key trajectory ref through the pulse width modulation as follows.

While the black key 1*b* or white key 1*c* is traveling on the reference key trajectory ref, the built-in plunger sensor 8 and key sensor 6 supply the plunger velocity signal ym and key position signal yk to the servo controller 12. The actual plunger velocity is approximately equal to the actual key velocity. The servo controller 12 calculates a value of target key velocity on the basis of a series of values of target key position, and compares the actual key position and actual key velocity with the target key position and target key velocity so as to determine a value of positional deviation and a value of velocity deviation. When the positional deviation and velocity deviation are found, the servo controller 12 increases or decreases the amount of mean current of the driving signal DR in order to minimize the positional deviation and velocity deviation. Thus, the servo controller 12 forms a feedback control loop together with the solenoid-operated key actuators 5, built-in plunger sensors 8 and key sensors 6. The servo controller 12 repeats the servo control sequence, and forces the black keys 1*b* and white keys 1*c* to travel on the reference key trajectories ref.

The recording system 80 includes the key sensors 6, hammer sensors 7, a recorder 13 and a music data producer 14. The recorder 13 and music data producer 14 are realized through execution of another subroutine program of the computer program running on the controlling unit 91.

The hammer sensors 7 monitor the hammers 3, respectively, and supply hammer position signals yh representative of pieces of hammer position data to the recorder 13. In this instance, the optical position transducer is used as the hammer sensors 7, and is same as that used as the key sensors 6.

While a human player is recording his or her performance on the upright piano 1, the recorder 13 periodically fetches the pieces of key position data and pieces of hammer position data, and analyzes the key movements and hammer movements on the basis of the pieces of key position data and pieces of hammer position data. The recorder 13 determines key numbers assigned to the depressed keys 1*b*/1*c* and released keys 1*b*/1*c*, time at which the black keys 1*b* and white keys 1*c* start to travel toward the end positions, actual key velocity on the way toward the end positions, time at which the black keys 1*b* and white keys 1*c* start to return toward the rest positions, the key velocity on the way toward the rest positions, time at which the hammers 3 are brought into collision with the strings 4 and final hammer velocity immediately before the collision. These pieces of key motion data and pieces of hammer motion data are transferred from the recorder 13 to the music data producer 14.

The music data producer 14 normalizes the pieces of key position data and pieces of hammer motion data, and produces MIDI music data codes from the pieces of key motion data and pieces of hammer motion data after the normalization. Both of the pieces of key motion data and pieces of hammer motion data are referred to as "pieces of performance data". The music data producer 14 eliminates individuality of the automatic player piano from the pieces of performance data through the normalization. The individualities of the automatic player piano are due to differences in sensor position, sensor characteristics and dimensions of component parts. Thus, the pieces of performance data of the automatic player piano are normalized into pieces of performance data of an ideal automatic player piano. The pieces of music data are produced from the pieces of performance data for the ideal automatic player piano, and are stored in the music data codes.

The music data codes are stored in a proper information storage medium, or are supplied through a communication network to another musical instrument or a data storage.

Figure 2:
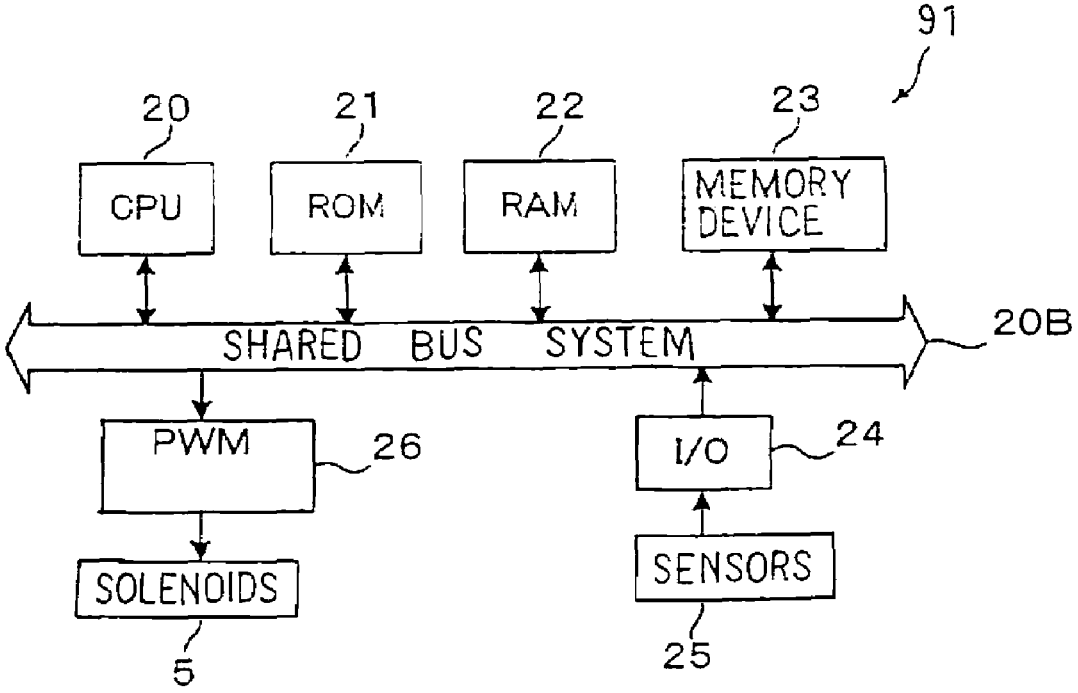
FIG. 2 is a block diagram showing the system configuration of a controlling unit incorporated in the automatic player piano.

Turning to FIG. 2 of the drawings, the controlling unit 91 includes a central processing unit 20, which is abbreviated as "CPU", a read only memory 21, which is abbreviated as "ROM", a random access memory 22, which is abbreviated as "RAM", a memory device 23, a signal interface 24, which is abbreviated as "I/O", a pulse width modulator 26, which is abbreviated as "PWM", and a shared bus system 20B. The central processing unit 20, read only memory 21, random access memory 22, memory device 23, signal interface 24 and pulse width modulator 26 are connected to the shared bus system 20B so that the central processing unit 20 is communicable with the read only memory 21, random access memory 22, memory device 23, signal interface 24 and pulse width modulator 26 through the shared bus system 20B. Although an electronic tone generator, a display panel and a manipulating board are incorporated in the controlling unit 91, they are omitted from FIG. 2 together with a graphic controller and a switch detector for the sake of simplicity.

"Sensors 25" stand for the key sensors 6, hammer sensors 7 and plunger sensors 8. Analog-to-digital converters are incorporated in the signal interface 24, and the plunger sensors 8, key sensors 6 and hammer sensors 7 are connected to the analog-to-digital converters in the signal interface 24. An MIDI interface, an interface for a control board, a graphic interface for a display unit, a communication interface connected to a public communication network and suitable digital interface for a personal computer system are incorporated in the interface 24.

The driving signals DR are selectively supplied from the pulse width modulator 26 to the solenoids 5*c* of solenoid-operated key actuators 5. The pulse width modulator 26 is responsive to a control signal supplied from the central processing unit 20 so as to vary the mean current or duty ratio of the driving signal DR.

The central processing unit 20 is an origin of the data processing capability, and the computer program runs on the central processing unit 20 for given tasks.

Instruction codes, which form the computer program, are stored in the read only memory 21, and are sequentially fetched by the central processing unit 20. One of the tasks expressed by the instruction codes is a data fetch from the signal interface 24, and the task is periodically repeated. The computer program will be hereinlater described in detail. Semiconductor mask ROM devices and semiconductor electrically erasable and programmable ROM devices are incorporated in the read only memory 21. Suitable parameter tables are further stored in the read only memory 21, and the central processing unit 20 looks up the parameter tables for the automatic playing and recording.

The random access memory 22 offers a working area to the central processing unit 20, and pieces of music data, pieces of key position data, pieces of hammer position data, pieces of plunger velocity data and pieces of reference key trajectory data are temporarily stored in the working area. A memory location is assigned to an internal clock, which is implemented by software, and the lapse of time from the initiation of playback is measured with the internal clock. A memory area is assigned to pieces of key event data, and the pieces of key event data are gathered for each of the eighty-eight keys 1*b*/1*c*.

The memory device 23 has data holding capability much larger than that of the random access memory 22, and is, by way of example, implemented by a hard disk driver, a flexible disk driver such as a floppy disk driver, the term "floppy disk" of which is a trademark, a compact disk driver for a CD-ROM (Compact Disk Read Only Memory), an MO (Magneto-Optical) disk, a DVD (Digital Versatile Disk) and a zip disk. A set of music codes may be transferred from the memory device 23 to the random access memory 22 for the automatic playing and vice versa for the recording. Plural music data files are usually prepared in the memory device 23. In this instance, each set of music data codes forms a standard MIDI file.

Figure 3:
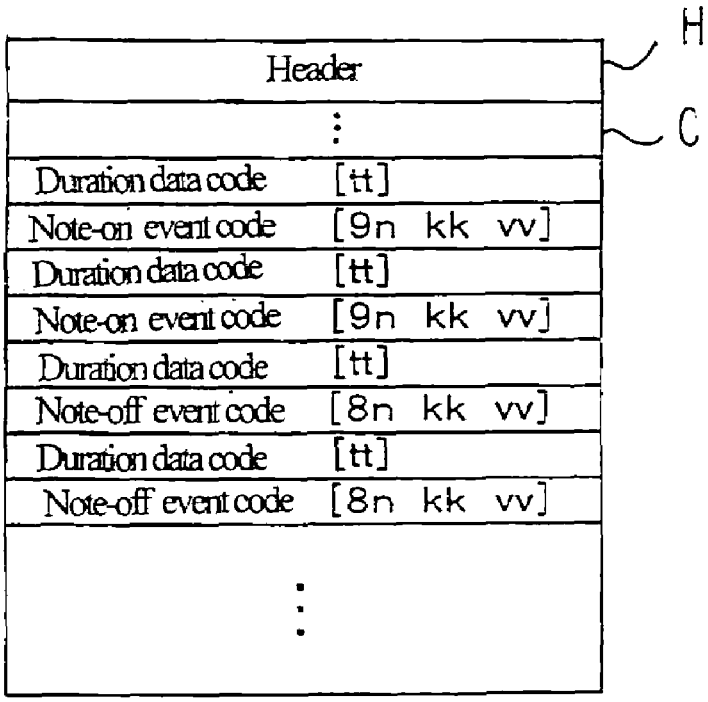
FIG. 3 is a view showing the contents of a standard MIDI file.

FIG. 3 shows one of the standard MIDI files. The standard MIDI file is broken down into a header H and a data chunk C. The data chunk C follows the header H, and pieces of music data are stored in the data chunk C.

The pieces of music data express the key events and lapse of time [tt] from the previous key events. The key events, i.e., the key-on event and key-off event are stored in a note-on event code and a note-off event code, and the lapse of time [tt] between a key event and the previous key event is stored in a duration data code. The lapse of time [tt] between two events is referred to as "a delta time". The note-on event and note-off event are referred to as a "note event".

The note event is expressed by a status byte and a data byte or bytes. The status byte expresses a note-on message and a channel message [9n] or a note-off message and a channel message [8n]. The channel is expressed as "n". On the other hand, the data bytes express a note number [kk], i.e., the pitch of a tone to be produced and a velocity [vv]. In case of a piano equipped with eighty-eight keys, the note number [kk] is varied from twenty-one to a hundred-seven, i.e., 21 to 108.

For this reason, the note number [kk] is specified with the key numbers respectively assigned to the black and white keys 1*b*/1*c*, and the word "key number [kk]" is used as a synonym of "note number". The velocity [vv] expresses the loudness of tones, and has 128 grades.

Since the delta time expresses the lapse of time from the previous note event, the lapse of time from the initiation of performance is indicated through accumulation of the values of delta time. In the following description, the lapse of time from the previous note event, i.e., the delta time is referred to as a "relative time period", and the lapse of time from the initiation of a performance, i.e., the accumulated delta time is referred to as an "absolute time period". An internal clock is assigned to the measurement of absolute time period.

Description is hereinafter made on the computer program. The computer program is broken down into a main routine program and subroutine programs. While the main routine program is running on the central processing unit 20, a user is communicable with the controlling unit 91 through the manipulating board (not shown) and display window (not shown). Current status and prompt messages are produced on the display window, and the user gives his or her instructions to the controlling unit 91 through the manipulating board.

One of the subroutine programs is assigned to the recording system 80, and another subroutine program is assigned to the automatic playing system 10. When a user instructs the recording system 80 to record his or her performance on the upright piano 1, the main routine program starts periodically to branch to the subroutine program for the recording, and the recorder 13 and music data producer 14 are realized through the execution of subroutine program. Similarly, when a user instructs the automatic playing system 10 to reproduce a performance recorded in a standard MIDI file, the main routine program starts periodically branch to the subroutine program for the automatic playing, and the music information processor 10*a*, motion controller 11 and servo controller 12 are activated. The black keys 1*b* and white keys 1*c* are selectively depressed and released so as to produce the piano tones along the music passage.

Figure 4A:
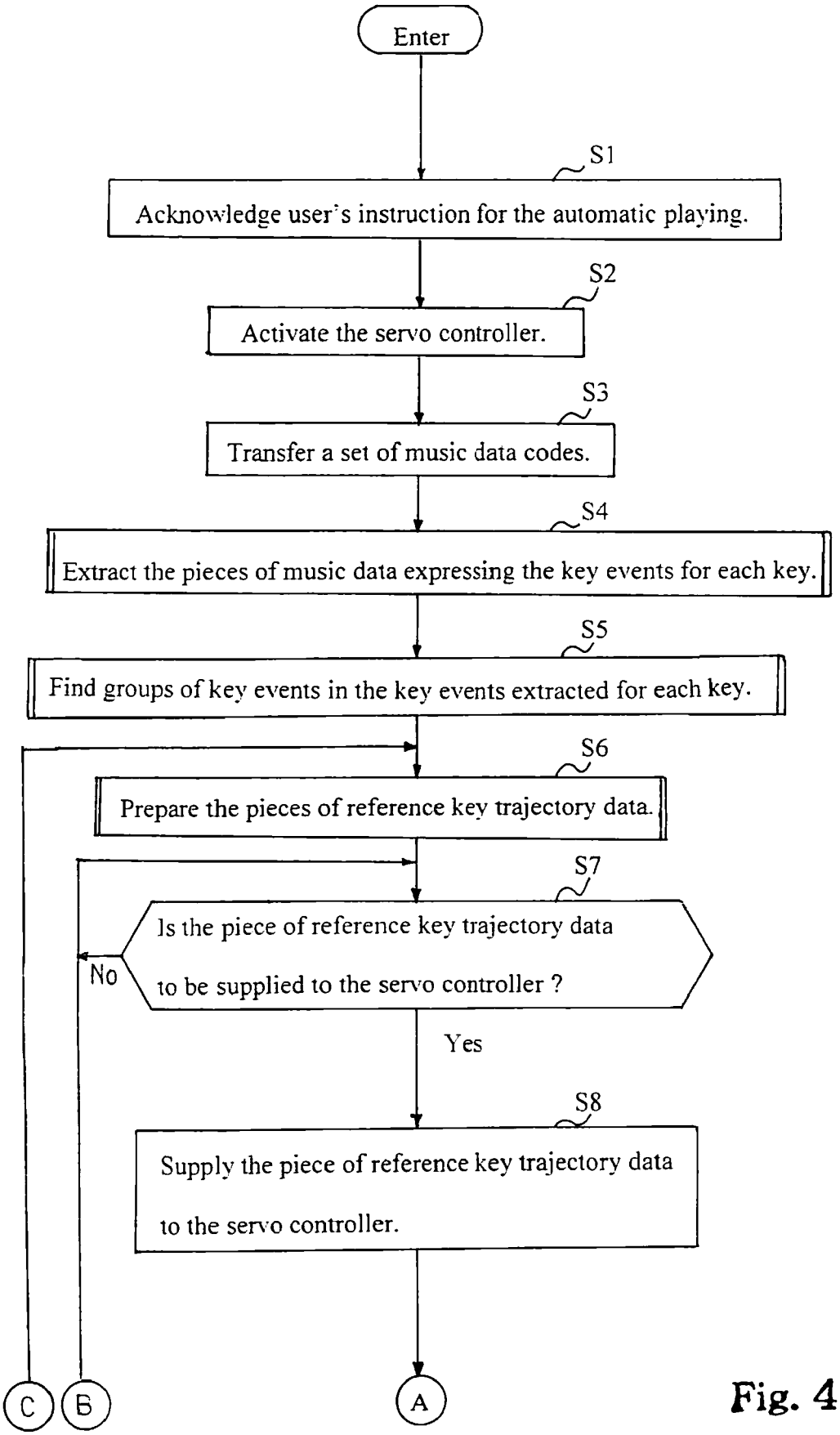
FIGS. 4A and 4B are flowcharts showing a subroutine program for an automatic playing.
Figure 4B:
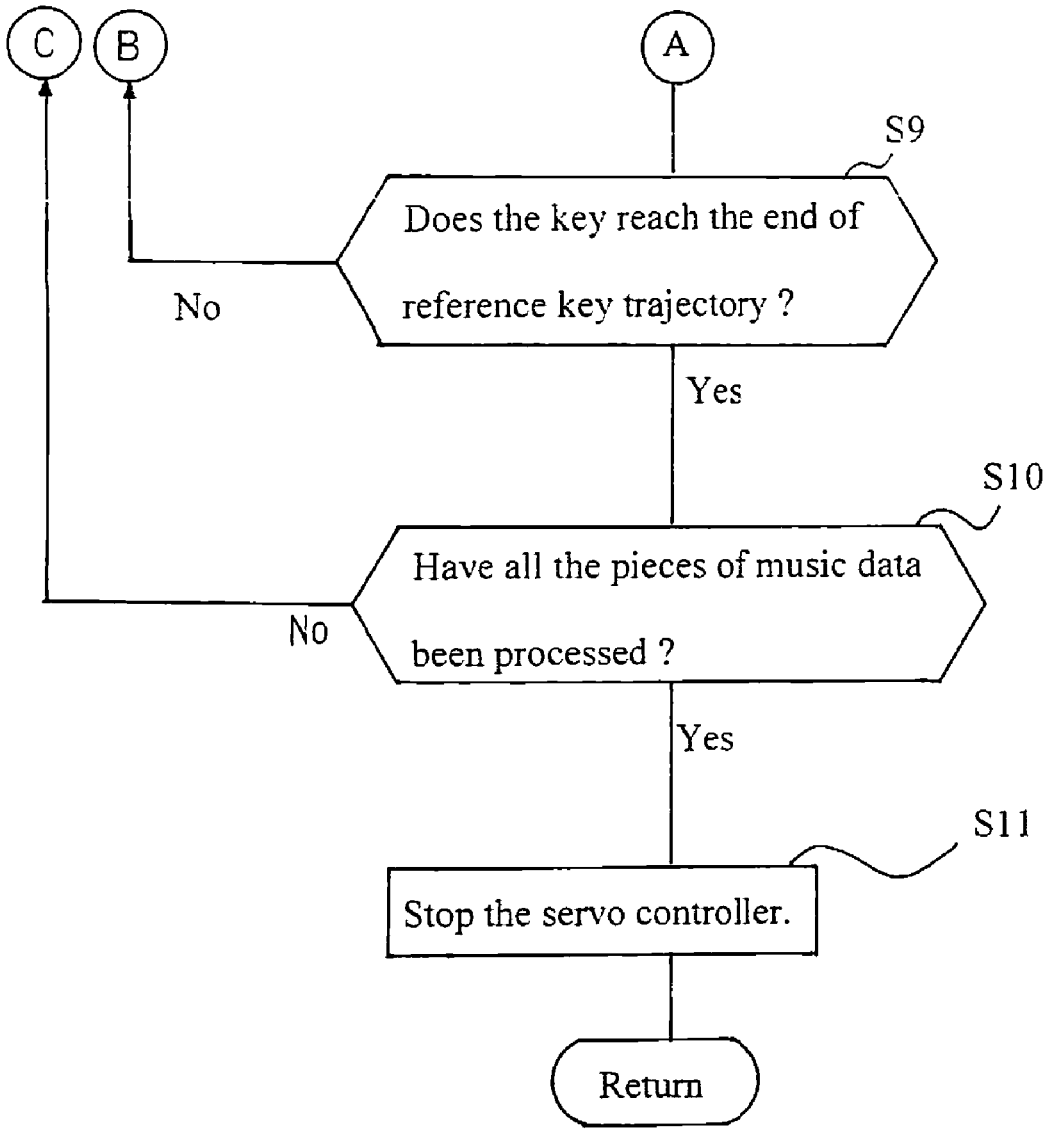

FIGS. 4A and 4B illustrate the subroutine program for the automatic playing. The central processing unit 20 realizes the music information processor 10*a*, motion controller 11 and servo controller 12 through the subroutine program shown in FIGS. 4A and 4B. When a user instructs an automatic playing to the controlling unit 91, the central processing unit 20 periodically enters the subroutine program for the automatic playing, returns to the main routine program, and enters the subroutine program, again, until acceptance of user's instruction for termination of automatic playing.

A user is assumed to instruct an automatic playing to the controlling unit 91 through the manipulating board (not shown). The central processing unit 20 periodically fetches input data codes from the signal interface 24 during the execution of the main routine program so that the instruction code representative of the user's instruction is taken into the random access memory 22. The central processing unit 20 examines the instruction code, and acknowledges the user's instruction for the automatic playing as by step S1.

The central processing unit 20 raises a flag indicative of the servo control, and gets ready to control the black and white keys 1*b*/1*c* through the servo control loop. In other words, the central processing unit 20 activates the servo controller 12 as by step S2. The servo control is achieved through execution of another subroutine program.

The user specifies a title of a piece of music through the manipulating board (not shown). Then, the central processing unit 20 searches the memory device 23 for the piece of music, and transfers a set of music data codes from the memory device 23 to the random access memory 22 as by step S3. In case where the set of music data codes is not found in the memory device 23, the standard MIDI file for the piece of music may be downloaded from a suitable database to the memory device 23 through the public communication network.

Upon completion of the transfer of the music data codes, the central processing unit 20 carries out the normalization and unit conversion, and, thereafter, starts to sort the key events, which are expressed by the music data codes, in accordance with the key numbers [kk]. In other words, the central processing unit 20 extracts the key events for each of the black and white keys 1*b*/1*c* as by step S4. Plural memory locations in the random access memory 22 are assigned to the black and white keys 1*b*/1*c*, respectively, and the key events for each key 1*b*/1*c* are stored in associated one of the memory locations. The job sequence for the sorting will be hereinlater described.

Subsequently, the central processing unit 20 searches the memory locations for a group or groups of key events. As described hereinbefore, a group of key events expresses the repetition of a black key 1*b* or a white key 1*c*. Thus, the central processing unit 20 tries to find a group or groups of key events as by step S5. A particular feature of the present invention is directed to a data processing on a group or groups of key events. For this reason, the jobs at steps S4 and S5 are carried out prior to the data processing on the group or groups of key events.

Although the central processing unit 20 is capable of concurrently executing the jobs at steps S6 to S9 for plural black and white keys 1*b*/1*c*, description is made on the assumption that plural keys 1*b*/1*c* are not concurrently driven for the travel on reference key trajectories for the sake of simplicity.

The central processing unit 20 determines the reference key trajectory or trajectories for a black key or white keys 1*b*/1*c* to be depressed and released at the earliest time as by step S6. In other words, the motion controller 11 is realized through the execution at step S6. The reference key trajectory has at least one reference forward key trajectory and at least one reference backward key trajectory, and the depressed key 1*b*/1*c* and released key 1*b*/1*c* travel on the reference forward key trajectory and reference backward key trajectory, respectively. The central processing unit 20 transfers the pieces of reference key trajectory data, which express the reference key trajectory for the black/white key 1*b*/1*c* to be depressed soon, to a predetermined memory locations of the random access memory 22, and the pieces of reference key trajectory data are stored in the predetermined memory locations.

The central processing unit 20 checks the internal clock to see whether or not the black key 1*b* or white key 1*c* is to start the travel on the reference key trajectory as by step S7. While the answer at step S7 is being given negative "No", the central processing unit 20 repeats the execution at step S7, and waits for the change of answer.

When the time comes, the answer at step S7 is changed to affirmative "Yes", and the central processing unit 20 reads out the first piece of reference key trajectory data from the predetermined memory location of the random access memory 22, and transfers the first piece of reference key trajectory data to the servo controller 12 for the servo control. In detail, the central processing unit 20 determines the deviation between the target key position and the actual key position and the deviation between the target key velocity and the actual key velocity, and adjusts the driving signal DR to a value of mean current for minimizing the deviations by means of the pulse width modulator 26. The plunger sensor 8 and key sensor 6 report the actual key velocity and actual key position to the central processing unit 20. The driving signal DR is supplied from the pulse width modulator 26 to the solenoid-operated key actuator 5 so as to force the black key 1*b* or white key 1*c* to travel on the reference key trajectory.

The central processing unit 20 checks the predetermined memory location to see whether or not the last piece of reference key trajectory data has been already processed. In other words the central processing unit 20 determines whether or not the black key 1*b* or white key 1*c* reaches the end of the reference key trajectory as by step S9. While the black key 1*b* or white key 1*c* is still traveling on the reference key trajectory, the answer at step S9 is given negative "No". With the negative answer "No", the central processing unit 20 returns to step S7, and waits for the time at which the next piece of reference key trajectory data is to be processed. Thus, the central processing unit 20 reiterates the loop consisting of steps S7, S8 and S9 until the black key 1*b* or white key 1*c* reaches the end of the reference key trajectory.

When the black key 1*b* or white key 1*c* reaches the end of the reference key trajectory, the central processing unit 20 checks the random access memory 22 to see whether or not all the pieces of music data codes have been already processed as by step S10. While the piece of music is being continued, the answer at step S10 is given negative "No", and the central processing unit 20 returns to step S6 for preparation of the reference key trajectory for the next black key 1*b* or next white key 1*c*. Thus, the central processing unit 20 reiterates the loop consisting of steps S6 to S10 until the performance is completed. When the performance is completed, the answer at step S10 is given affirmative "Yes", and the central processing unit S11 pulls down the flag indicative of the servo controlling. In other words, the servo controller 12 stops the servo control on the black and white keys 1*b*/1*c* as by step S11.

Figure 5:
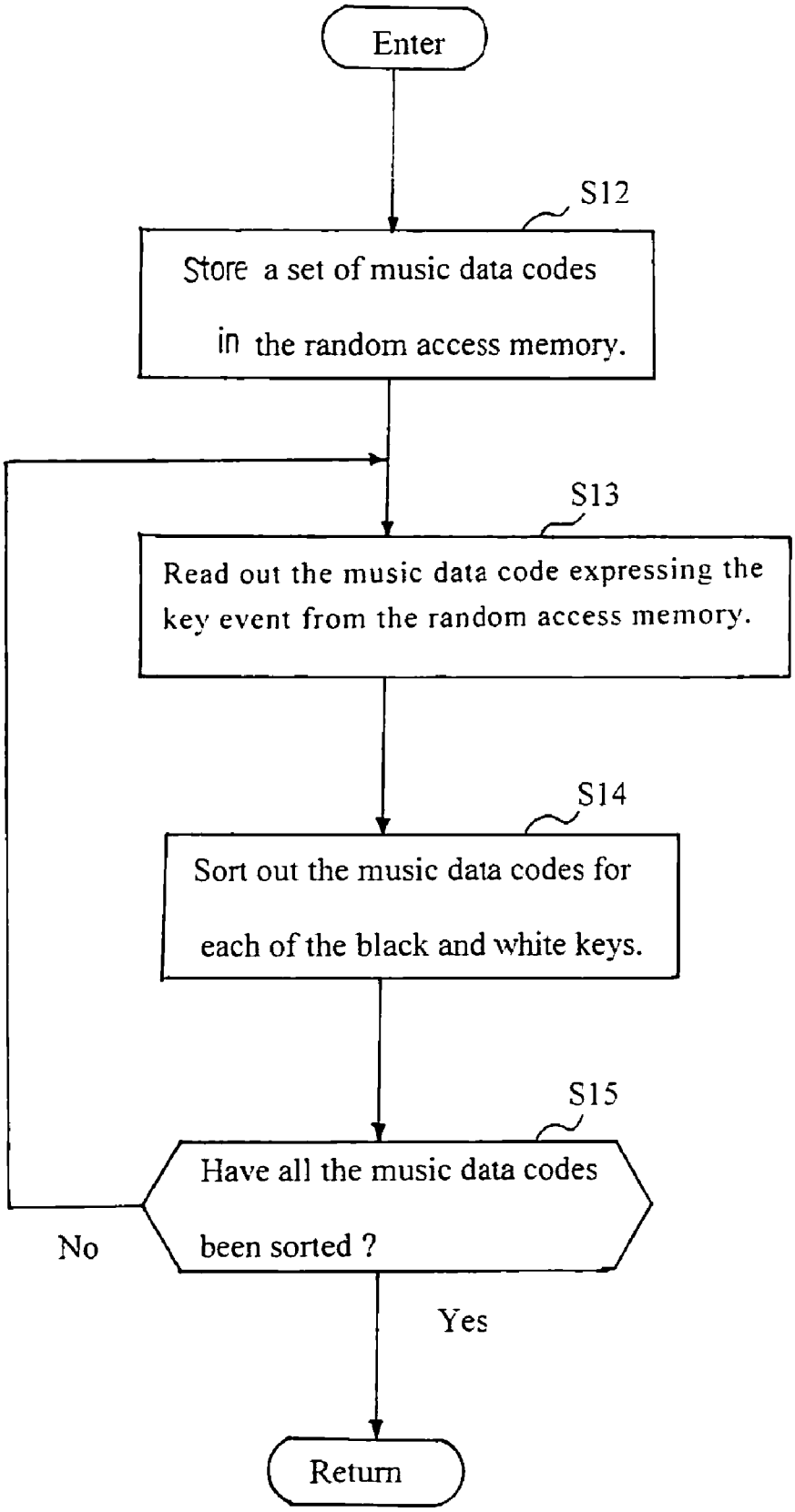
FIG. 5 is a flowchart showing a job sequence for sorting key events.

Subsequently, description is made on the job sequence at step S4 with reference to FIG. 5. As described hereinbefore, a set of music data codes expressing a piece of music is transferred to the random access memory 22 so that the duration data codes [tt], note-on event codes [9n kk vv] and note-off event codes [8n kk vv] are found in the random access memory 22 as similar to the data chunk C shown in FIG. 3.

Upon entry into the job sequence at step S4, the central processing unit 20 stores the set of music data codes, which is transferred from the memory device 23 at step S3, in the random access memory 22 as by step S12, and starts sequentially to fetch and sort out the music data codes. In detail, the central processing unit 20 reads out the first key event code from the random access memory 22 as by step S13. The central processing unit 20 specifies one of the black and white keys 1*b*/1*c* on the basis of the key number [kk], and writes the key event code into the memory location assigned to the key number [kk] as by step S14.

Subsequently, the central processing unit 20 checks the set of music data codes to see whether or not all the music data codes have been sorted as by step S15. If the central processing unit 20 finds at least one unprocessed key event code in the set of music data codes, the answer at step S15 is given negative "No", and the central processing unit 20 returns to step S13. Thus, the central processing unit 20 reiterates the loop consisting of steps S13 to S15 so as to sort out the music data codes expressing the key events in accordance with the key number [kk].

After sorting out the last key event code, the answer at step S15 is changed to affirmative "Yes", and the central processing unit 20 completes the job sequence.

Figure 6:
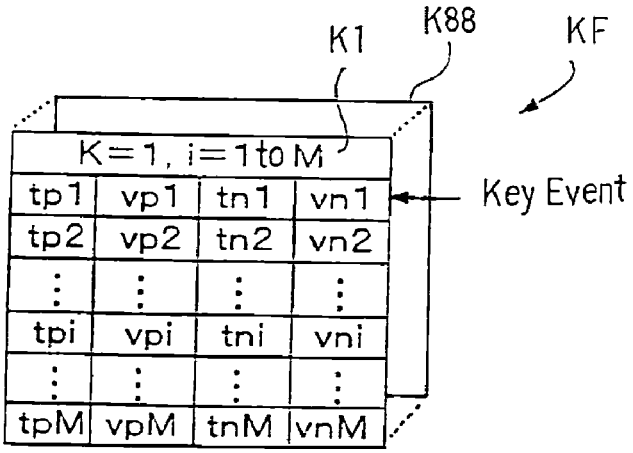
FIG. 6 is a view showing the structure of key event blocks.
Figure 1:
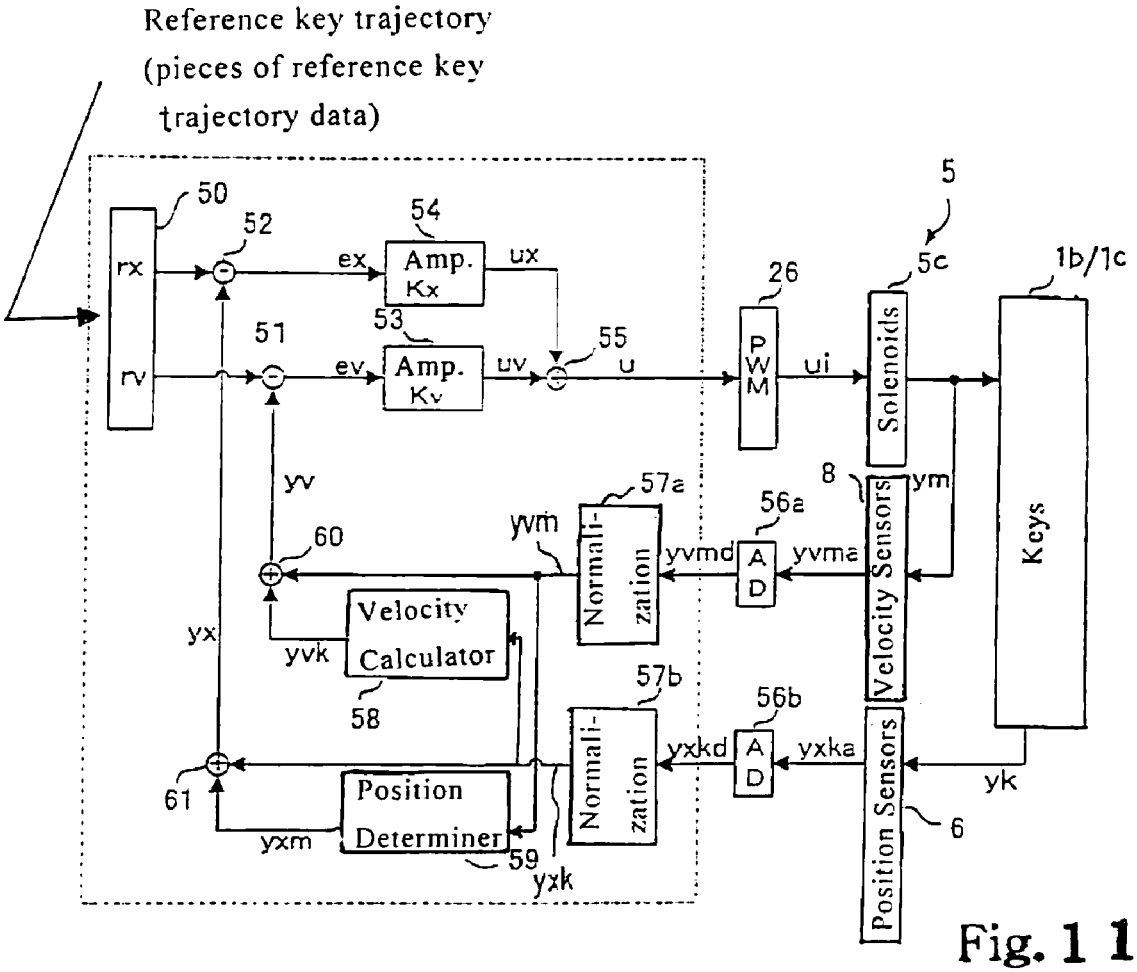

Upon completion of the sorting, a key event file KF is created for the piece of music as shown in FIG. 6. In this instance, eighty-eight key event blocks K1 to K88 form the key event file KF, and are stored at the aforementioned memory locations. Key event number "i" is the natural number from 1 to "M", and "M" is equal to the number of key events. Key event number "1" is assigned to the first key-on event and first key-off event, and the key event number is incremented toward "M", "M" key events form the key event block K1. M is dependent on the music passage to be reproduced by the automatic playing system 10. Another key event block may include more than or less than M key events.

The velocity at the key-on event "i" and velocity at the key-off event "i", i.e. note-on velocity and note-off velocity are expressed as "vpi" and "vni", respectively. The first note-on velocity is indicated as "vp1", and "vn1" stands for the first note-off velocity. The relative time period from the initiation of playback and the first key-on event is expressed as "tp1", and "tp2" to "tpM" stand for the relative time periods from the previous key-off events "1" to "M−1". The relative time period "tn1" to "tnM" are indicative of the lapse of time from the previous key-on events "1" to "M". Thus, the note-on velocity "vpi", relative time period "tpi", note-off velocity "vni" and relative time period "tni" are orderly stored in each of the key event blocks K1 to K88 in accordance with the key event number "i".

In the job sequence shown in FIG. 5, the central processing unit 20 firstly writes the relative time period "tpi", the note-on velocity "vpi" follows, subsequently, the central processing unit 20 writes the relative time period "tni", and, thereafter, writes the note-off velocity "vni". Upon completion of the data write-in for "tpi", "vpi", "tni" and "vni", the central processing unit 20 repeats the data write-in work on "tp(i+1)", "vp(i+1)", "tn(i+1)" and "vn(i+1)".

The job at step S14 is described in more detail. In the following description, term "latest music data code" means the note-on velocity code "vpi", note-off velocity code "vni" or duration data code "tpi"/"tni" at the end of the queue in each of the key event blocks K1 to K88.

The central processing unit 20 is assumed to read out the duration data code expressing the relative time period "tpi" or "tni". The central processing unit 20 successively reads out the latest music data codes from all the key event blocks K1 to K88, and determines whether the note-on velocity code/note-off velocity code or the relative time period "tpi"/"tni" is stored in each of the key event block K1 . . . or K88 as the latest music data code.

When the central processing unit 20 finds the duration code expressing "tp(i−1)" or "tn(i−1) as the latest duration code, the central processing unit 20 adds the relative time period "tpi" or "tni" to the relative time period "tp(i−1)" or "tp(i−1), and puts the duration data code expressing the sum at the end of the queue as the latest music data code. Thus, the relative time period is accumulated at the end of the queue.

If on the other hand, the central processing unit 20 finds the note-on velocity code "vpi" or note-off velocity code "vni" at the end of the queue, the central processing unit 20 writes the duration code "tpi" or "tni" expressing the relative time period "tpi" or "tni" after the note-on velocity code or note off velocity code, and the duration code "tpi" or "tni" occupies the end of the queue as the latest music data code.

The central processing unit 20 is assumed to read out the note-on event code or note-off event code. The central processing unit 20 reads the key number [kk] and velocity [vv] from the note-on event code or note-off event code. The central processing unit 20 determines the key event block K[kk] on the basis of the key number [kk] of the note-on event code or note-off event code, and writes the velocity [vv] as the note-on velocity "vpi" or note-off velocity "vni" at the end of the queue as the latest music data code. As a result, the relative time period "tpi" or "tni" is fixed to the total sum already accumulated. Although the note-on velocity code "vpi" for a certain key 1*b*/1*c* and note-off velocity code "vni" for the certain key 1*b*/1*c* are written in one of the key event blocks K1 to K88, the relative time periods "tpi" and "tni" are accumulated in all the key vent blocks K1 to K88, and, for this reason, the latest music data code expressing the relative time period "tpi" or "tni" is indicative of the lapse of time from the previous key-off event or previous key-on event.

Figure 7A:
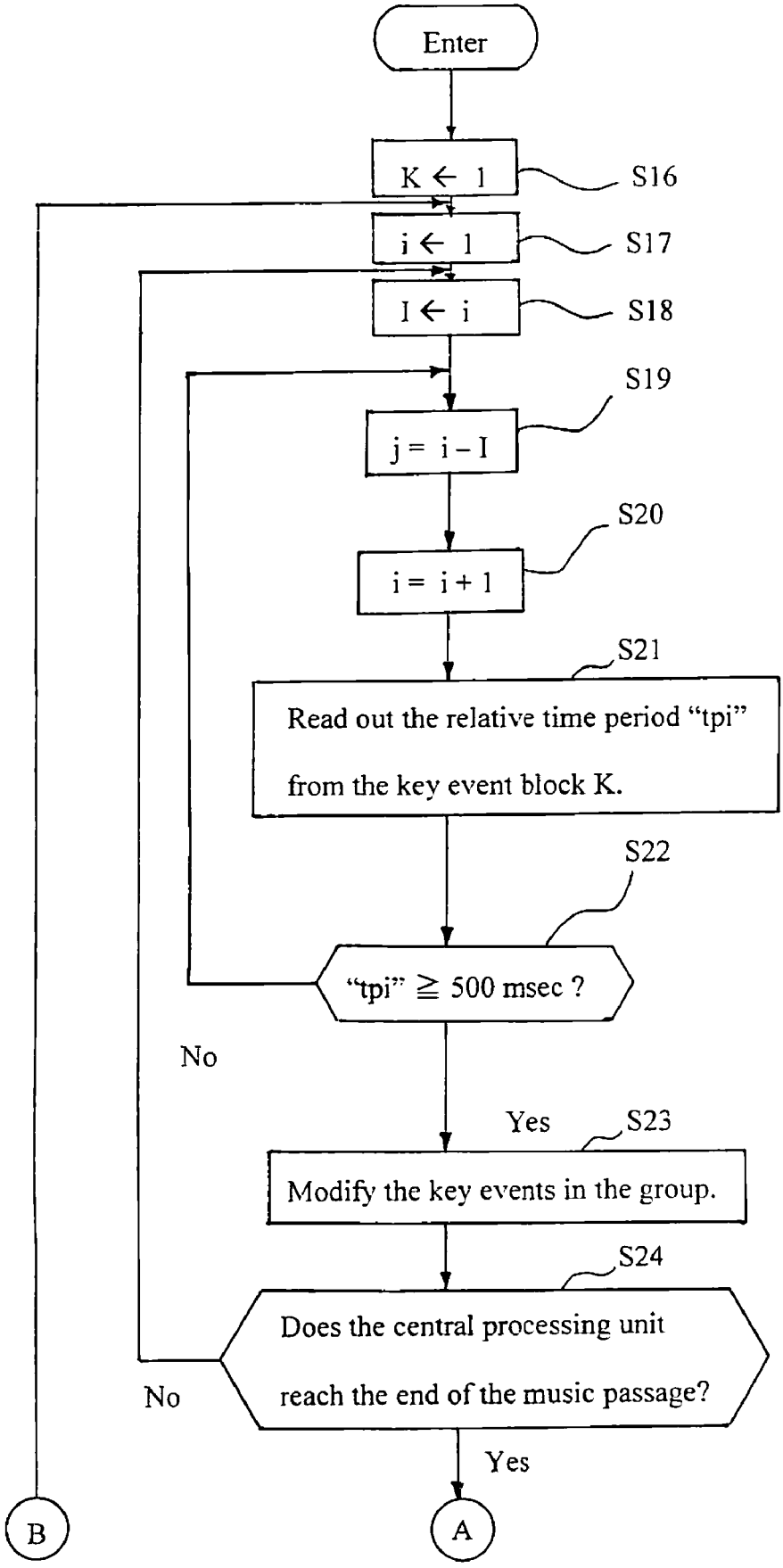
FIGS. 7A and 7B are flowcharts showing a job sequence for grouping key events.
Figure 7B:
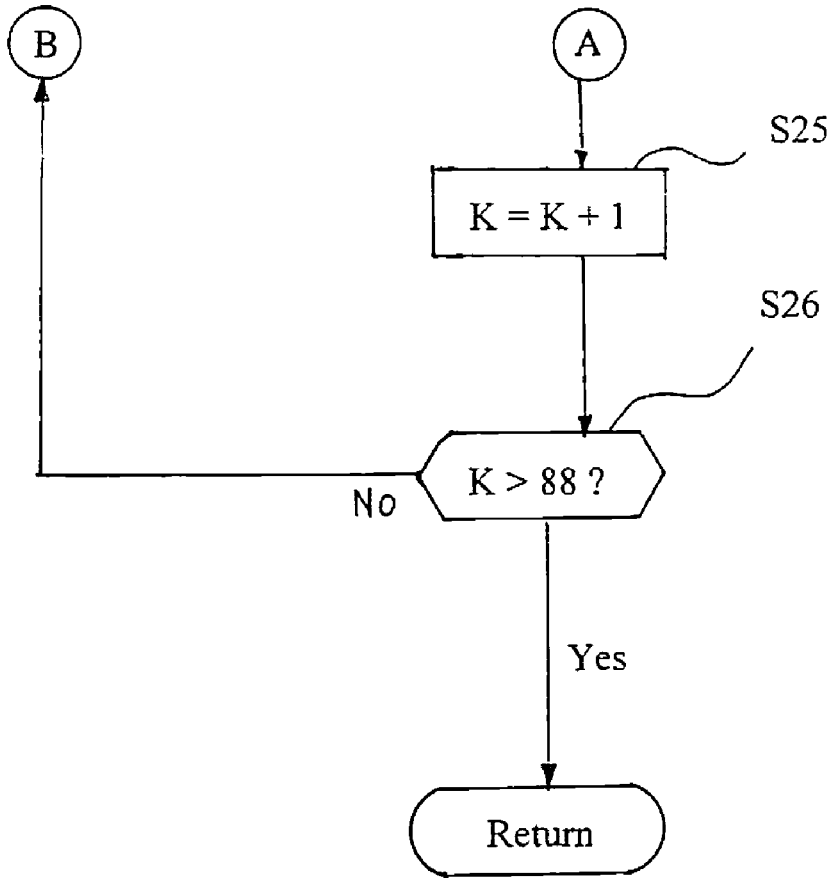

FIGS. 7A and 7B show a job sequence for grouping the key events at step S5. The execution on the job sequence is equivalent to a part of the music information processor 10*a*. The central processing unit 20 writes "1" into an index K, which expresses the key number" as by step S16, and further writes "1" into an index i expressing the key event as by step S17. The central processing unit 20 makes an index I equal to the index i as by step S18. The index I is indicative of the key event number at the head of a possible group of key events.

The central processing unit 20 subtracts the value of index I from the value of index i, and makes an index j equal to the difference of "i−I" as by step S19. The index j is indicative of the position of the key event in the group, and the position is varied from zero to N. In other words, (N+1) key events form the group of key events. Since the index j is defined as "i−I", the group of key events includes the key event assigned the key event number I to the key event assigned the key event number (I+N).

The central processing unit 20 increments the index i by 1 as by step S20. As a result, the index i is indicative of the next key event. The central processing unit reads out the relative time period "tpi" from the duration data code associated with the key event i as by step S21. The relative time period "tpi" expresses the lapse of time from the key-off event j immediately before the key-on event i.

Subsequently, the central processing unit 20 checks the relative time period "tpi" to see whether or not the key-on event i takes place within a predetermined time period from the previous key-off event j as by step S22. In this instance, the predetermined time period is 500 milliseconds, and is stored in the read only memory 21.

If the key-on event i is close to the key-off event j, the player repeatedly depresses the key 1*b*/1*c* assigned the key number K, and the answer at step S22 is given affirmative "No". If, on the other hand, the player depresses and releases another key 1*b*/1*c* assigned a key number different from the key number K, the lapse of time between the previous key-off event j and the key-on event i is equal to or longer than the predetermined time period, and the answer at step S22 is given affirmative "Yes".

With the negative answer "No" at step S22, the central processing unit 20 returns to step S19, and subtracts the value of index I from the index j. Since the index i was incremented by 1 at step S20, the index j is indicative of the key event before the increment. The central processing unit 20 repeats the jobs at step S20 and S21, and checks the lapse of time between the two key events to see whether or not the repetition is continued at step S22. Thus, the central processing unit 20 reiterates the loop consisting of steps S19 to S22 so as to form a group of key events expressing the repetition. The key event I to key event j form the group of key events.

When the answer at step S22 is changed to the positive answer "Yes", the central processing unit 20 proceeds to step S23, and modifies the music data codes expressing the group of key events. The jobs at step S23 will be hereinlater described in detail.

Upon completion of the jobs at step S23, the central processing unit 20 checks the key event block labeled with the key number 1 to see whether or not all the music data codes have been already examined as by step S24.

If at least one music data code remains unexamined, the answer at step S24 is given negative "No", and the central processing unit 20 returns to step S18 so as to make the index I equal to the index i. In other words, the key number at the head of a possible group of key events is changed. The central processing unit 20 reiterates the loop consisting of steps S19 to S22 in order to find another group of key events. If the central processing unit 20 finds another group of key events, the central processing unit 20 modifies the music data codes at step S23, and checks the key event block to see whether or not all the music data codes have been already examined at step S24.

When the index i is equal to M, the answer at step S24 is changed to affirmative "Yes", and the central processing unit 20 increments the index K by one as by step S25. Subsequently, the central processing unit 20 checks the index K to see whether or not all the key event blocks K1 to K88 have been examined as by step S26. While the index K is being found from 1 to 88, the central processing unit 20 returns to step S17, and reiterates the loop consisting of steps S17 to S26 so as to find a group of key events or groups of key events for the black and white keys 1*b*/1*c*.

Even if the tpi is shorter than the predetermined time period at step S22, the central processing unit 20 proceeds to step S23 in so far as the index i is equal to M.

Upon completion of the examination on the key event block K88, the answer at step S26 is changed to affirmative "Yes", and the central processing unit 20 completes the jobs at step S5.

Figure 8:
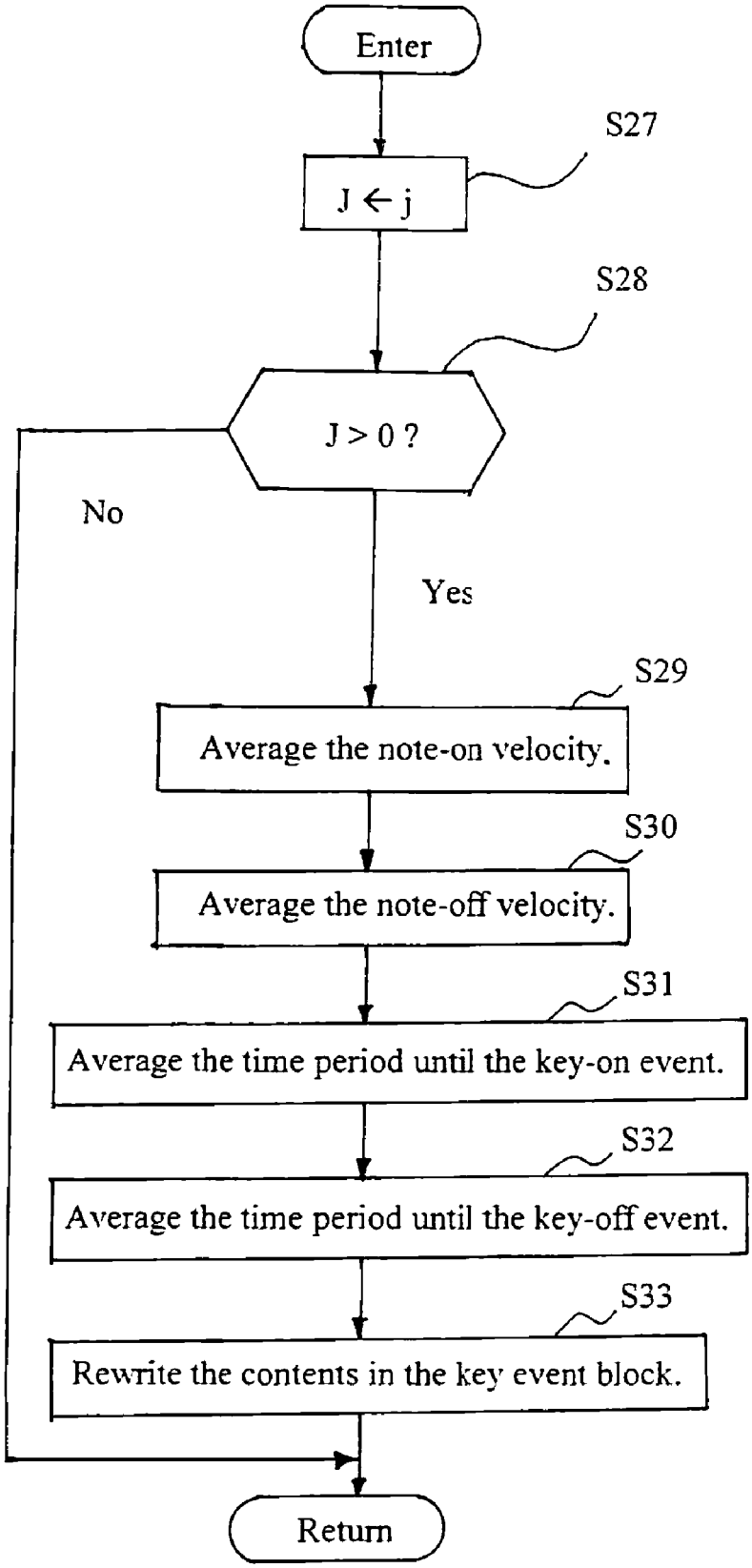
FIG. 8 is a flowchart showing a job sequence for modifying music data codes in a group of key events.

Description is hereinafter made on the modification of music data codes in a group of key events with reference to FIG. 8. In FIG. 8, index "i" is indicative of the key event number as similar to the index "i" in FIG. 7. The index i is varied from I to (I+N) in the group of key events. In other words, the group of key events includes N key events. The execution of the instructions shown in FIG. 8 is equivalent to another part of the music information processor 10*a*.

First, the central processing unit 20 confirms the index "j", which expresses the number of key events incorporated in the group of key events, and makes a variable J equal to the index j as by step S27. The central processing unit 20 checks the variable J to see whether or not the number of key events is greater than zero as by step S28. As described hereinbefore, the index j is from zero to N, and the negative answer "No" is given at step S28 on the condition that only one key event forms the group. With the negative answer "No" at step S28, the central processing unit 20 returns to the job sequence shown in FIGS. 7A and 7B.

On the other hand, in case where more than one key event forms the group, the answer at step S28 is given affirmative "Yes". The group of key events expresses a repetition. Then, the central processing unit 20 modifies the note-on velocity, relative time period between the previous key-off event and the key-on event, note-off velocity and relative time period between the previous key-on event and the key-off event.

The central processing unit 20 determines an average vpav of the note-on velocity vpj at step S29 by using Equation 1. The index j is varied from zero to J.

$$vpav = \sum_{J=0}^{J} (vpj)/(J+1) \quad \text{Equation 1}$$

The central processing unit 20 determines an average vnav of the note-off velocity vnj at step S30 by using Equation 2. The index j is varied from zero to J.

$$vnav = \sum_{J=0}^{J} (vnj)/(J+1) \quad \text{Equation 2}$$

Subsequently, the central processing unit 20 determines an average of the lapse of time tpj from the previous key-off event to the key-on event as by step S31. The index j is varied from 1 to J so that the first lapse of time tp0 in the group, is maintained. In other words, the central processing unit 20 does not change the lapse of time from the previous group of key events to the first key-on event at the head of the group of key events. i.e., the first key-on timing. The average tpav is expressed as follows.

$$tpav = \sum_{J=1}^{J} (tpj)/(J) \quad \text{Equation 3}$$

Finally, the central processing unit 20 determines an average tnav of the lapse of time from the previous key-on event to the key-off event as by step S32. Since the index j is varied from zero to (J−1), the central processing unit 20 maintains the lapse of time from the last key-off event to the key-on event in the next group of key events, i.e., the last key-off timing in the group of key events. As a result, the lapse of time tpJ is unchanged. The average tnav is expressed as follows.

$$tnav = \sum_{J=0}^{J-1} (tnj)/(J) \quad \text{Equation 4}$$

Thus, the central processing unit 20 determines the average note-on velocity vpav, average note-off velocity vnav, average lapse or time tpav and average lapse of time tnav without changing the first note-on timing and last note-off timing, i.e., tp0 and tnJ in the group.

Subsequently, the central processing unit 20 replaces all of the note-on velocity vp0 to vpJ, all of the note-off velocity vn0 to vnJ, lapse of time tp1 to tpJ and lapse of time tn0 to tnJ−1 in the group of key events with the average note-on velocity vpav, average note-off velocity vnav, average lapse of time tpav and average lapse of time tnav as by step S33. The central processing unit 20 remains the first lapse of time tp0 and the last lapse of time tnJ unchanged.

After the execution at step S33, the central processing unit 20 returns to step S24, and the jobs at steps S27 to S33 are repeated for all of the black and white keys 1*b*/1*c*.

Figure 9:
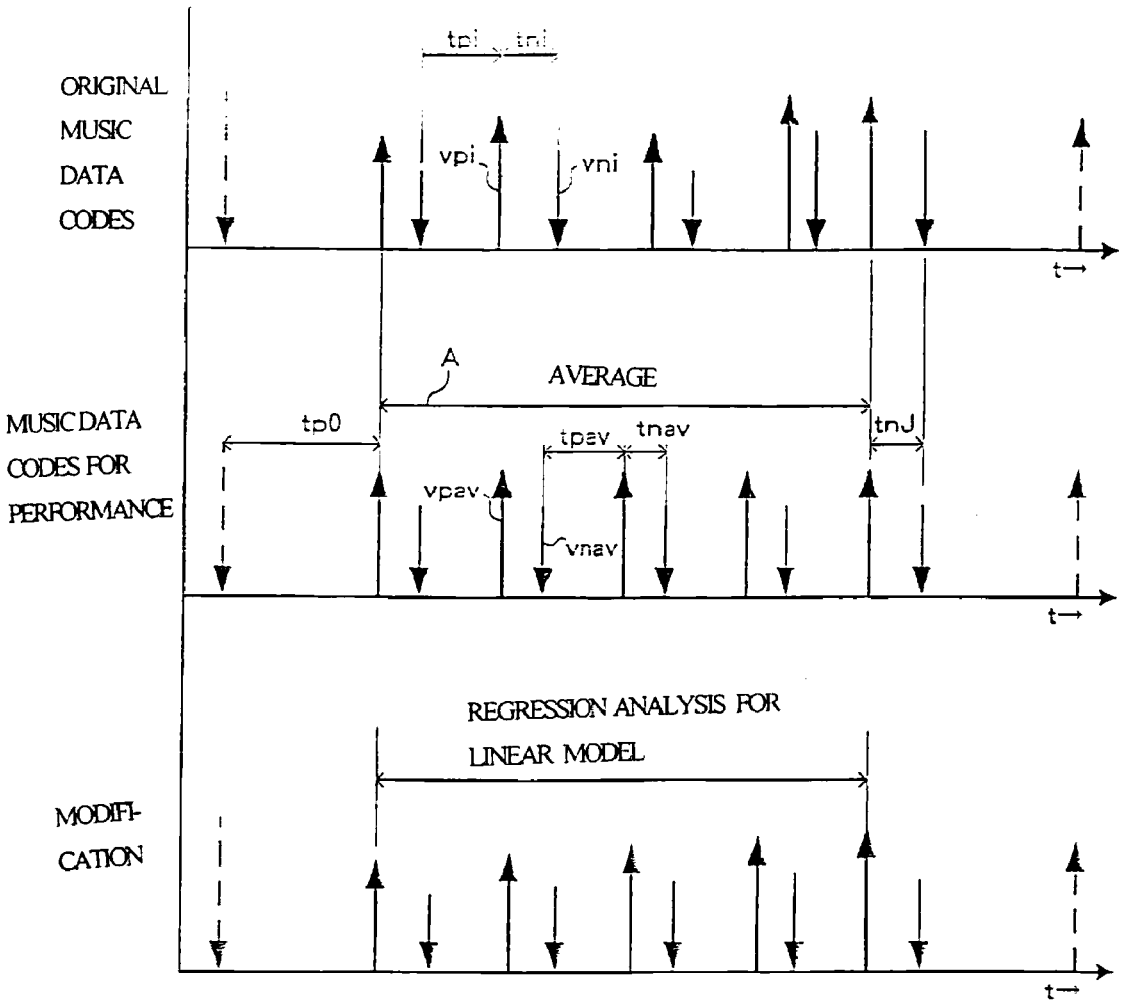
FIG. 9 is a timing chart showing a group of key events before a modification and the group of key events after the modification.

FIG. 9 shows the music data codes expressing the key events in a group of key events. The key-on events are expressed by arrows projecting from a time base t, and the key-off events are expressed by arrows toward the time base t. The length of arrows is proportional to the note-on velocity vpi or note-off velocity vni, and the lapses of time tpi and tni are expressed by the gap between two adjacent arrows on the time base t. Although the arrows drawn in real lines stand for the key events in the group, the key events in other groups are expressed by arrows drawn in broken lines.

The original music data codes is assumed to form a group of key events I to (I+N) as those labeled with "ORIGINAL MUSIC DATA CODES" in FIG. 9. The arrows, which stand for the note-on velocity and note-off velocity, are different in length, and the gap between adjacent two arrows is narrower than or wider than the other gaps. The note-on velocity vpi, note-off velocity vni and lapses of time tpi and tni are averaged in the time period A through the jobs at steps S27 to S33 so that the arrows and gaps have the average length and average distance as those labeled with "AFTER MODIFICATION". However, the lapses of time tp0 and tnJ are not changed.

Figure 10:
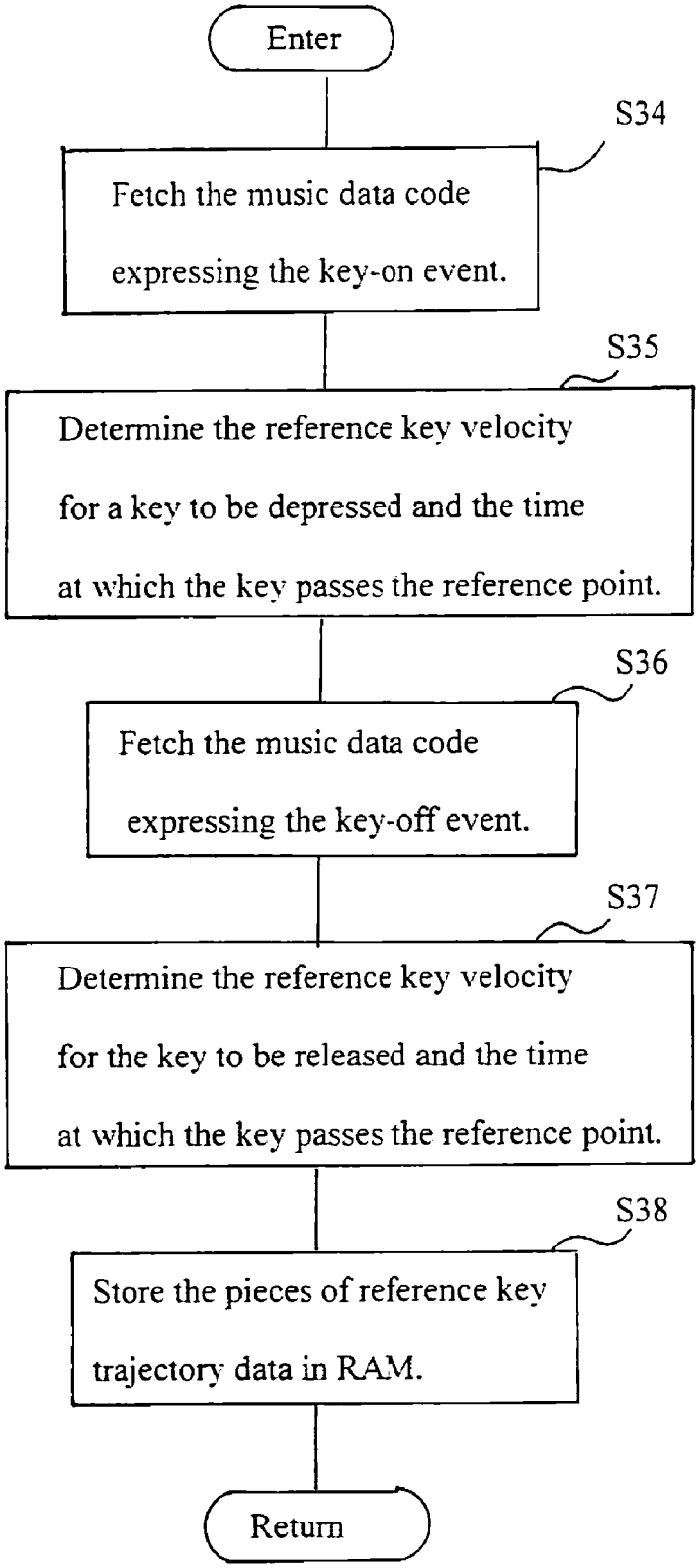
FIG. 10 is a flowchart showing a job sequence executed by a motion controller.

Subsequently, description is made on the behavior of the motion controller 11. FIG. 10 shows a job sequence for the motion controller 11. While the central processing unit 20 is reproducing a performance expressed by a set of music data codes, the job sequence is repeated for the black keys 1*b* and white keys 1*c* to be depressed and released.

A black key 1*b* is assumed to be depressed and released in the playback. The central processing unit 20 accesses the key event block assigned to the black key 1*b*, and reads out the music data code expressing the note-on velocity vpi and lapse of time tpi from the key event block as by step S34.

As described hereinbefore, the note-on velocity vpi expresses the loudness of a tone to be produced. The final hammer velocity V11 is proportional to the loudness of tone. It is possible to say that the note-on velocity vpi expresses the final hammer velocity VH. On the other hand, the time period expressed by tpi is expired at the time TH to produce the tone. In case of the automatic player piano, the string 4 is struck with the hammer 3 at the time TH. The lapses of time tpi and tni are accumulated so that the time TH is put on the absolute time base.

Subsequently, the central processing unit 20 determines a reference forward key velocity Vr and a reference forward time Tr on the basis of the final hammer velocity VH and time TH as by step S35. The reference forward key velocity Vr is defined as "key velocity of a depressed key 1*b*/1*c* at the reference forward point X". In standard acoustic pianos, the reference forward point X is found at the key positions spaced from the rest positions by 9.0 to 9.5 millimeters along the key trajectories. Since the final hammer velocity VH is proportional to the reference forward key velocity Vr, the tone is produced at the target loudness in so far as the reference forward key velocity Vr is given to the key black key 1*b* or white key 1*c*. The reference time Tr is defined as "the time at which the black key 1*b* or white key 1*c* passes the reference point X."

The reference forward key velocity Vr is determinable through a linear approximation, and is expressed as $$Vr = \alpha \times VH + \beta \quad \text{Equation 5}$$

where α and β are constants determined through experiments.

The reference forward time Tr is expressed as $$\Delta t = -(\gamma/VH) + \delta \quad \text{Equation 6}$$

where Δt is the lapse of time from the reference forward time Tr to the time TH at which the string 4 is struck with the hammer 3 and γ and δ are constants determined through experiments. The central processing unit 20 subtracts the time period Δt from the absolute time TH, and determines the reference forward time Tr.

A time TR to start the rest position is earlier than the reference forward time Tr by the lapse of time consumed by the key 1b/1c between the rest position and the reference forward point X, and is calculated as $$TR=Tr-X/Vr \quad \text{Equation 7}$$

The black key 1b is assumed to take the uniform motion on the key trajectory. The reference forward key trajectory is expressed as (Vr×(t−TR)+XR) where t is the absolute time and XR is the rest position i.e., the keystroke of zero. The central processing unit 20 produces pieces of reference forward key trajectory data, which express the reference forward key trajectory.

Subsequently, the central processing unit 20 fetches the music data codes expressing the key-off event, which follows the aforementioned key-on event, from the key event block assigned to the black key 1b as by step S36, and reads out the note-off velocity vni and lapse of time tni. The note-off velocity vni expresses a key velocity VKN, which is less than zero, of a released key 1b/1c, and the relative time period tni is expired at the key-off event. The released time TKN is defined on the time base, and is, accordingly, the absolute time.

Subsequently, the central processing unit 20 determines a reference backward key velocity VrN, which is less than zero, and a reference backward time TrN. A reference backward point XN is defined as "keystroke at which the dampers 39 are brought into contact with the strings 4." The reference backward key velocity VrN is defined as "a velocity of released key at the reference backward point XN, and the reference backward time TrN is defined as "a time at which the released key, which starts at the end of the keystroke, reaches the reference backward point XN."

The released key 1b is assumed to take the uniform motion. The reference backward point XN is expressed as $$XN=VrN\times TrN'+XE \quad \text{Equation 8}$$

where XE is the end position at the keystroke of 10 millimeters, TrN' is the relative time period consumed by the key 1b/1c from the end position XE to the reference backward point XN. The initial key velocity is equal to the reference backward key velocity VrN and released key velocity VKN on the assumption that the key 1b/1c takes the uniform motion. The starting time TEN at which the key 1b/1c starts the backward movement is the difference between the absolute time TrN and the relative time period TrN'. The reference backward key trajectory, which satisfies the reference backward key velocity VrN and reference backward time TrN, is expressed as (VrN×(t−TEN)+XE) where t is the absolute time. The central processing unit 20 produces pieces of reference backward key trajectory data, which expresses the reference backward key trajectory.

The central processing unit 20 stores the pieces of reference forward key trajectory data, pieces of reference backward key trajectory data and pieces of stationary data expressing the key position from time TE and time TEN in the random access memory 22 as the pieces of reference key trajectory data at step S38.

The pieces of reference key trajectory data are sequentially supplied to the servo controller 12 so that the servo controller 12 forces the black key 1b to travel on the reference forward key trajectory, stay between time TE and time TEN and travel on the reference backward key trajectory.

FIG. 11 shows the servo control loop, which the servo controller 12, key sensors 6 and plunger sensors 8 form in combination. Although the black and white keys 1b/1c, solenoid-operated key actuators 5, position sensors 6, which are implemented by the key sensors 6, velocity sensors 8, which are implemented by the plunger sensors 8, pulse width modulator 26 and analog-to-digital converters 56a/56b, which are incorporated in the signal interface 24, are hardware, the other blocks 50, 51, 52, 53, 54, 55, 57a, 57b, 58, 59, 60 and 61 stand for functions realized through execution of a part of the subroutine program for the playback. The analog plunger velocity signal yvma and analog key position signal yxka are converted to a digital plunger velocity signal yvmd and a digital key position signal yxkd by means of the analog-to-digital converters 56a and 56b so that the digital plunger velocity signal yvmd and digital key position signal yxkd also express the current plunger velocity and current key position.

The boxes 51 and 52 serve as comparators or subtractors, and boxes 53 and 54 serve as amplifiers. The box 55 serves as an adder. The boxes 57a and 57b eliminate individualities of the automatic playing system 10 from the digital plunger velocity signal yvmd and digital key position signal yxkd, and converts the unit of plunger velocity and unit of key position to the millimeter-second unit system. Thus, the boxes 51 and 52 normalize those digital signals yvmd and yxkd. A digital plunger velocity signal yvm and a digital key position signal yxk express the normalized current plunger velocity and normalized current key position, respectively. The normalized current plunger velocity and normalized current key position are also labeled with "yvm" and "yxk".

The box 58 calculates a current key velocity yvk on the basis of the normalized current key position yxk through a differentiation such as a poly-nominal approximation, and the box 59 determines a current plunger position yxm on the basis of the normalized current plunger velocity yvm through an integration. The boxes 60 and 61 serve as adders, and determine an actual key velocity yv and an actual key position yx on the basis of the normalized current plunger velocity yvm, normalized current key position yxk, current key velocity yvk and current plunger position yxm. The actual key velocity yv and actual key position yx are transferred to the boxes 51 and 52, respectively.

Assuming now that a piece of reference key trajectory data ref is supplied to the box 50, the box 50 determines a target key position rx and a target key velocity rv for the black/white key 1b/1c at time t, and supplies the target key position rx and target key velocity rv to boxes 52 and 51, respectively. The target key velocity rv is expressed in centimeter per second. The pieces of reference key trajectory reach the box 50 at time intervals of 1 millisecond, and, accordingly, the target key position rx and target key velocity rv are renewed at the time intervals.

In this instance, the servo controller 12 motion controller 11 determines the reference key trajectory on the assumption that the black keys 1b and white keys 1c take the uniform motion. Therefore, the target key velocity rv is constant. While the black/white key 1b/1c is traveling on the reference forward key trajectory, the target key velocity rv is equal to the reference forward key velocity Vr. On the other hand, the target key velocity rv is equal to the reference backward key velocity VrN on the reference backward key trajectory. The target key position rv is found on the reference key trajectory.

The target key velocity rv and target key position rx are transferred from the box 50 to the comparators 51 and 52, respectively, and the actual key velocity yv and actual key position yx are transferred from the adders 60 and 61 to the comparators 51 and 52. The comparators 51 and 52 determines a velocity difference ev between the target key velocity rv and the actual key velocity yv and a positional difference ex between the target key position rx and the actual key position yx. The velocity difference uv and positional difference ux are transferred from the comparators 51 and 52 to the amplifiers 53 and 54.

The velocity difference uv is amplified at gain of Kv in the amplifier 53, and the positional difference ux is amplified at gain o Kx in the amplifier 54, and the products uv and ux are supplied from the amplifiers 53 and 54 to the adder 55. Thus, the adder 55 makes the velocity difference and positional difference united. The sum u is indicative of a target amount of mean current, and is supplied to the pulse width modulator 26.

The pulse width modulator 26 is responsive to the sum u so as to adjust the mean current ui of driving signal DR to the sum u, and supplies the solenoid-operated key actuator 5 for the black/white key 1*b*/1*c*. The driving signal DR makes the solenoid 5*a* change the plunger velocity ym and, accordingly, the current key position yk. Thus, the servo controller 12 changes the amount of mean current of the driving signal DR on the basis of the velocity difference ev and positional difference ex, and forces the black keys 1*b* and white keys 1*c* to travel on the reference key trajectories ref.

As will be understood from the foregoing description, the repetition is discriminated from the single stroke key motion through the comparison between the relative time periods of key events and the predetermined time period. When the repetition is found in the performance to be reproduced, the key-on events and key-off events are modified so as to average the key movements. Even if a player depresses a black key 1*b* or white key 1*c* at an extremely high-speed key movement and/or within an extremely short lapse of time, the extremely high-speed key movement and/or extremely sort lapse of time is eliminated from the repetition through the averaging so that the automatic playing system 10 makes it possible to reproduce the repetition in the playback. cl Second Embodiment An automatic player piano implementing the second embodiment largely comprises an upright piano and an automatic playing system, and the upright piano and automatic playing system are same in hardware as the upright piano 1 and automatic playing system 10. For this reason, component parts of upright piano and system components of automatic playing system are labeled with references designating the corresponding component parts of upright piano 1 and corresponding system components of automatic playing system 10.

A computer program for the second embodiment is similar to the computer program for the first embodiment except for a subroutine program for playback. For this reason, the main routine program and other subroutine programs are not hereinafter described for the sake of simplicity.

A difference between the first embodiment and the second embodiment resides in how the controlling unit 91 makes the key event uniform. In the first embodiment, the music information processor 10*a* forms the groups of key events as shown in FIGS. 7A and 7B, and makes the key events uniform in each of the groups of key events as shown in FIG. 8. In the second embodiment, the motion controller 11 forms groups of reference key trajectories expressing repetitions, and modifies the reference key trajectories in each group.

Figure 12:
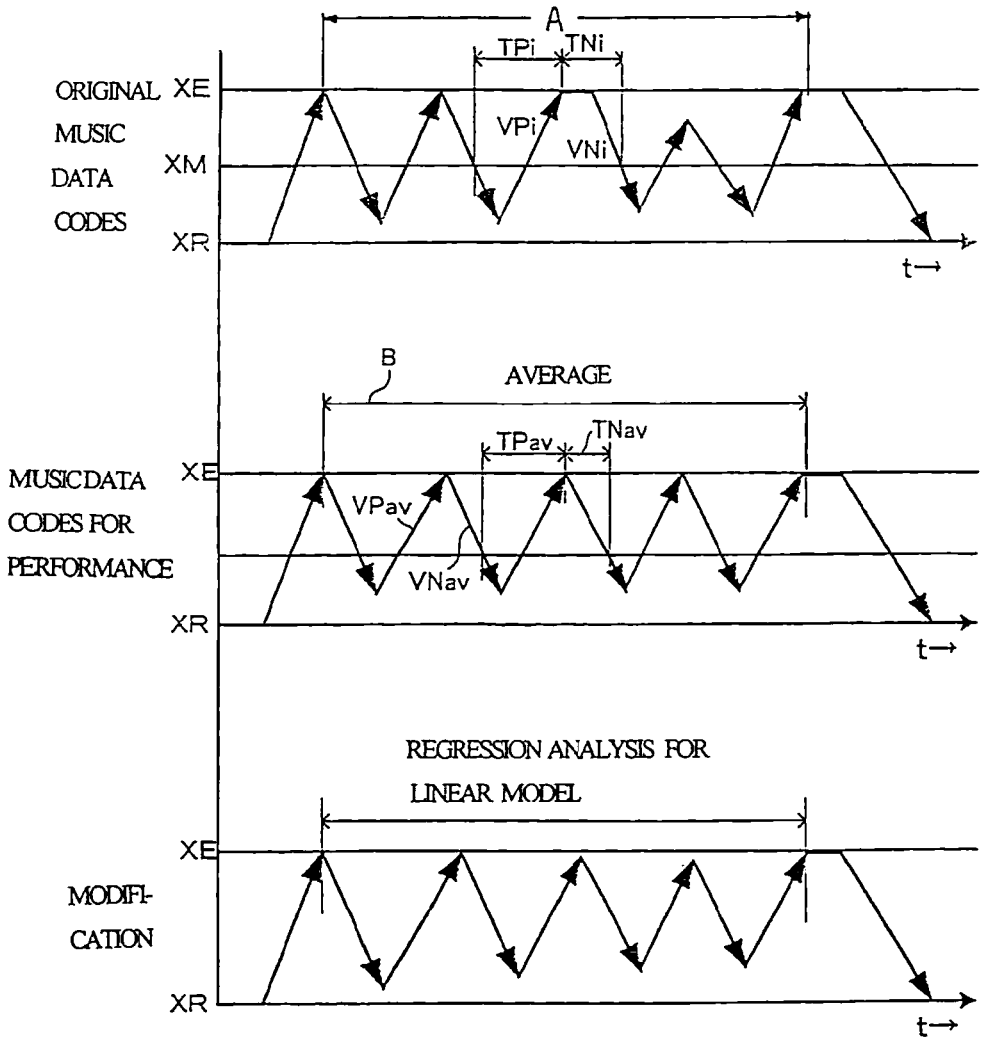
FIG. 12 is a timing chart showing a group of reference key trajectories before and after the modification.

FIG. 12 shows a data processing on a group of key events. The time flows in a direction labeled with "t". The black keys 1*b* and white keys 1*c* are moved between the rest positions XR and the end positions XE. "XM" is indicative of intermediate key positions between the rest positions XR and the end positions XE. Arrows toward the end positions and arrows toward the rest positions stand for the reference forward key trajectories and reference backward key trajectories, respectively. A group of original music data codes is indicative of the reference forward key trajectories and reference backward key trajectories. Although the black/white key 1*b*/1*c* is kept at the end position XE (see the third reference forward key trajectory and the third reference backward key trajectory) and returns to the rest position on the way to the end position (see the fourth reference forward key trajectory and the fourth reference backward key trajectory), the stay at the end position and return from the intermediate position are eliminated from the reference key trajectories through the modification. However, a time period A is equal to a time period B. In other words, the time period for the repletion is equal between in the group of original music data codes and in the group of modified music data codes. Thus, the motion controller 11 makes the key-on events and key-off events uniform.

Figure 13A:
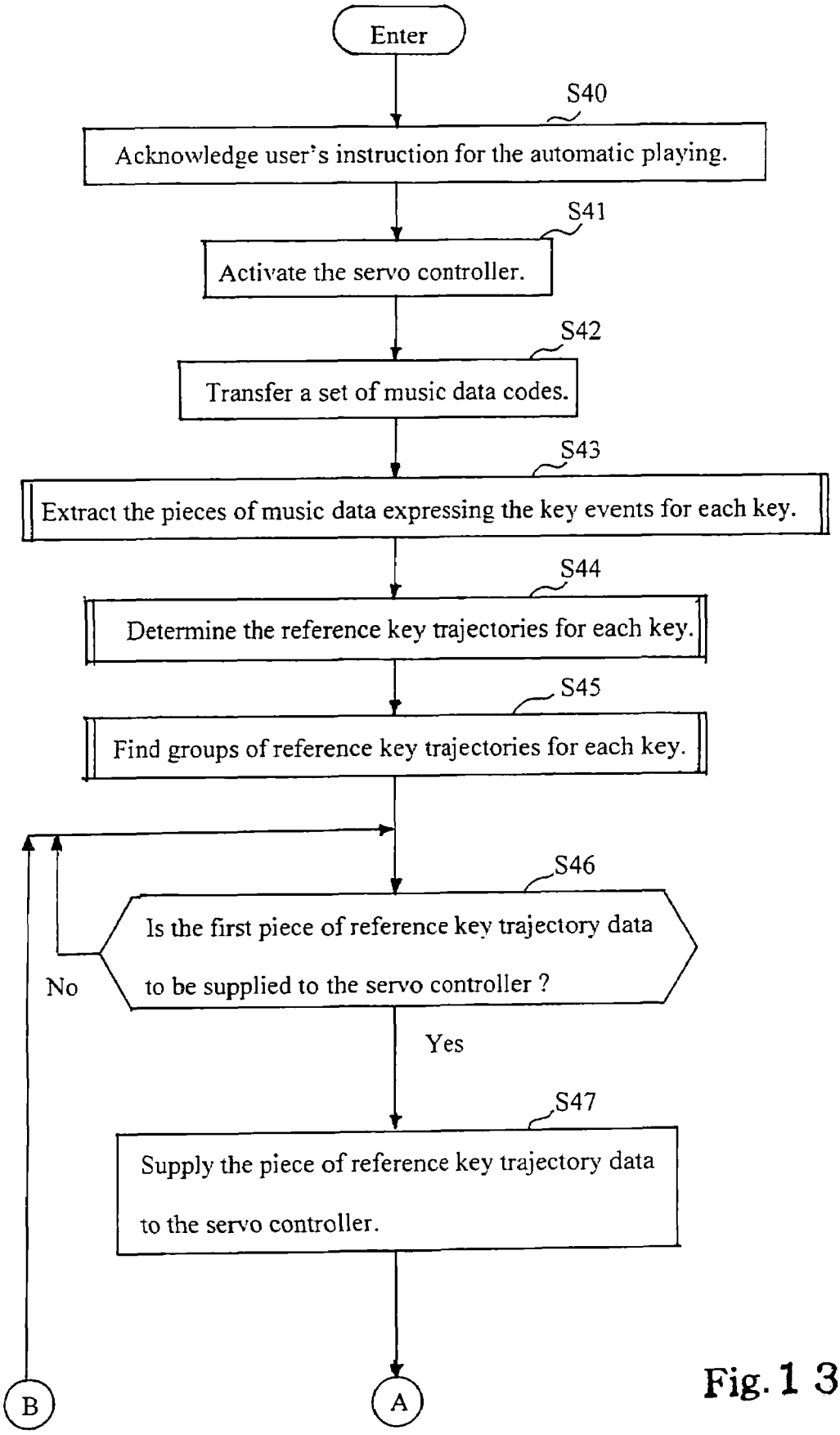
FIGS. 13A and 13B are flowcharts showing a subroutine program for playback incorporated in a computer program of another automatic player piano of the present invention.
Figure 13B:
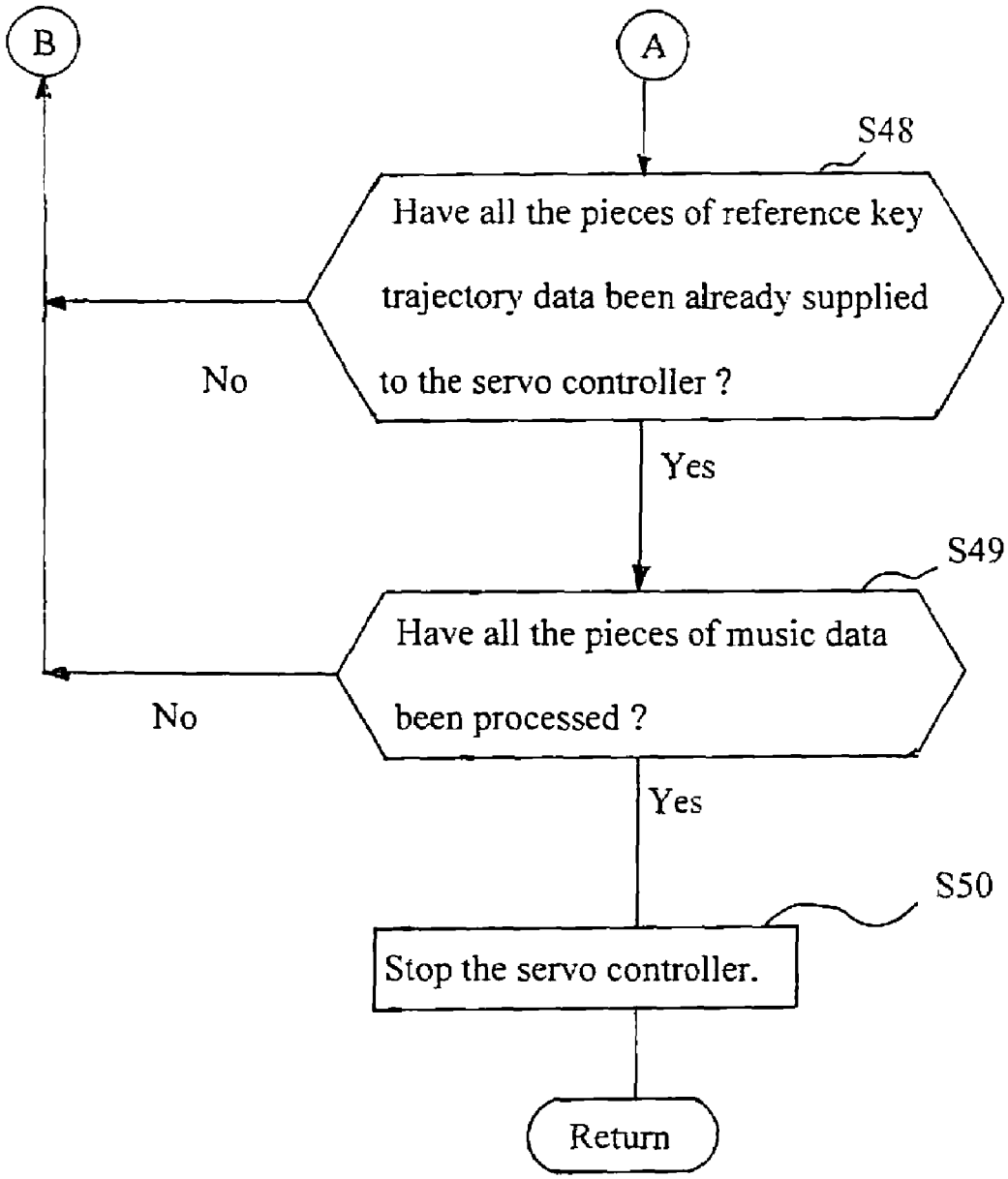

FIGS. 13A and 13B show a subroutine program for playback. A user is assumed to instruct an automatic playing to the controlling unit 91 through the manipulating board (not shown). The central processing unit 20 periodically fetches input data codes from the signal interface 24 during the execution of the main routine program so that the instruction code representative of the user's instruction is taken into the random access memory 22. The central processing unit 20 examines the instruction code, and acknowledges the user's instruction for the automatic playing as by step S40.

The central processing unit 20 raises a flag indicative of the servo control, and gets ready to control the black and white keys 1*b*/1*c* through the servo control loop. In other words, the central processing unit 20 activates the servo controller 12 as by step S41. The servo control is achieved through execution of another subroutine program.

The user specifies a title of a piece of music through the manipulating board (not shown). Then, the central processing unit 20 searches the memory device 23 for the piece of music, and transfers a set of music data codes from the memory device 23 to the random access memory 22 as by step S42.

Upon completion of the transfer of the music data codes, the central processing unit 20 carries out the normalization and unit conversion, and, thereafter, starts to sort the key events, which are expressed by the music data codes, in accordance with the key numbers [kk]. In other words the central processing unit 20 extracts the key events for each of the black and white keys 1*b*/1*c* as by step S43. Since the plural memory locations are assigned to the black and white keys 1*b*/1*c*, respectively, the key events for each key 1*b*/1*c* are stored in associated one of the memory locations.

Subsequently, the central processing unit 20 determines the reference key trajectories for each of the black and white keys 1*b*/1*c* as by step S44. Eighty-eight reference key trajectory data blocks are respectively assigned to the eighty-eight keys 1*b*/1*c*. The pieces of reference key trajectory data for each of the black and white keys 1*b*/1*c* are stored in one of the reference key trajectory data blocks in order of the absolute time from the initiation of playback. The pieces of reference key trajectory data for a pair of key-on event and key-off event will be hereinlater described in detail. The memory locations may be shared between the key events and the reference key trajectories in order to link the key events with the reference key trajectories. The black keys 1*b* and white keys 1*c* are assumed to take the uniform motion, and the job sequence at step S44 is similar to the job sequence shown in FIG. 10.

Figure 14:
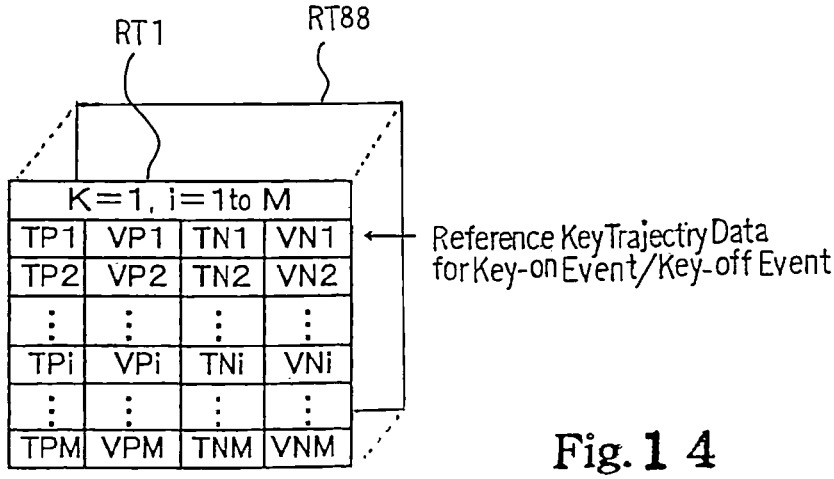
FIG. 14 is a view showing the structure of reference key trajectory data blocks.

FIG. 14 shows the reference key trajectory data blocks RT1 to RT88. The reference key trajectory data blocks RT1 to RT88 are respectively assigned to the black and white keys 1*b*/1*c* assigned the key numbers from 1 to 88. Index K is indicative of the key number [kk], and index i is indicative of the key event number.

TPi, VP1, TN1 and VN1 are described with concurrent references to FIGS. 12 and 14. TPi expresses the lapse of time from a time at which a black/white key 1b/1c starts to travel on the reference forward key trajectory to a time at which the black/white key 1b/1c passes the intermediate position XM on the reference backward key trajectory. VPi expresses the reference forward key velocity Vr on the reference forward key velocity. TNi expresses the lapse of time from a time at which a black/white key 1b/1c starts to travel a reference backward key trajectory to a time at which the black/white key 1b/1c passes the intermediate position on the reference backward key trajectory. VNi expresses the reference backward key velocity VrN on the reference backward key trajectory.

Turning to FIGS. 13A and 13B, the central processing unit 20 searches the reference key trajectory data blocks to see whether or not some of the reference key trajectories form a group of reference key trajectories indicative of a repetition. When the answer is given affirmative, the reference key trajectories are linked with one another, and form a group of reference key trajectories. Thus, the central processing unit 20 form a group or groups of reference key trajectories for each of the black and white keys 1b/1c.

The central processing unit 20 checks the internal clock to see whether or not the black key 1b or white key 1c is to start the travel on the reference key trajectory as by step S46. While the answer at step S46 is being given negative "No", the central processing unit 20 repeats the execution at step S46, and waits for the change of answer.

When the time comes, the answer at step S46 is changed to affirmative "Yes", and the central processing unit 20 reads out the first piece of reference key trajectory data from associated one of the reference key trajectory data blocks of the random access memory 22, and transfers the first piece of reference key trajectory data to the servo controller 12 as by step S47. The servo control on the black and white keys 1b/1c is similar to that shown in FIG. 11, and no further description is hereinafter incorporated for avoiding repetition.

The central processing unit 20 checks the reference key trajectory data block to see whether or not the last piece of reference key trajectory data has been already processed. In other words, the central processing unit 20 determines whether or not the black key 1b or white key 1c reaches the end of the reference key trajectory as by step S48. While the black key 1b or white key 1c is still traveling on the reference key trajectory, the answer at step S48 is given negative "No". With the negative answer "No", the central processing unit 20 returns to step S46, and waits for the time at which the next piece of reference key trajectory data is to be processed. Thus, the central processing unit 20 reiterates the loop consisting of steps S46, S47 and S48 until the black key 1b or white key 1c reaches the end of the reference key trajectory.

When the black key 1b or white key 1c reaches the end of the reference key trajectory, the central processing unit 20 checks the random access memory 22 to see whether or not all the pieces of music data codes have been already processed as by step S49. While the piece of music is being continued, the answer at step S49 is given negative "No", and the central processing unit 20 returns to step S46. Thus, the central processing unit 20 reiterates the loop consisting of steps S46 to S49 until the performance is completed. When the performance is completed, the answer at step S49 is given affirmative "Yes", and the central processing unit S11 pulls down the lag indicative of the servo controlling. In other words, the servo controller 12 stops the servo control on the black and white keys 1b/1c as by step S50.

Figure 15A:
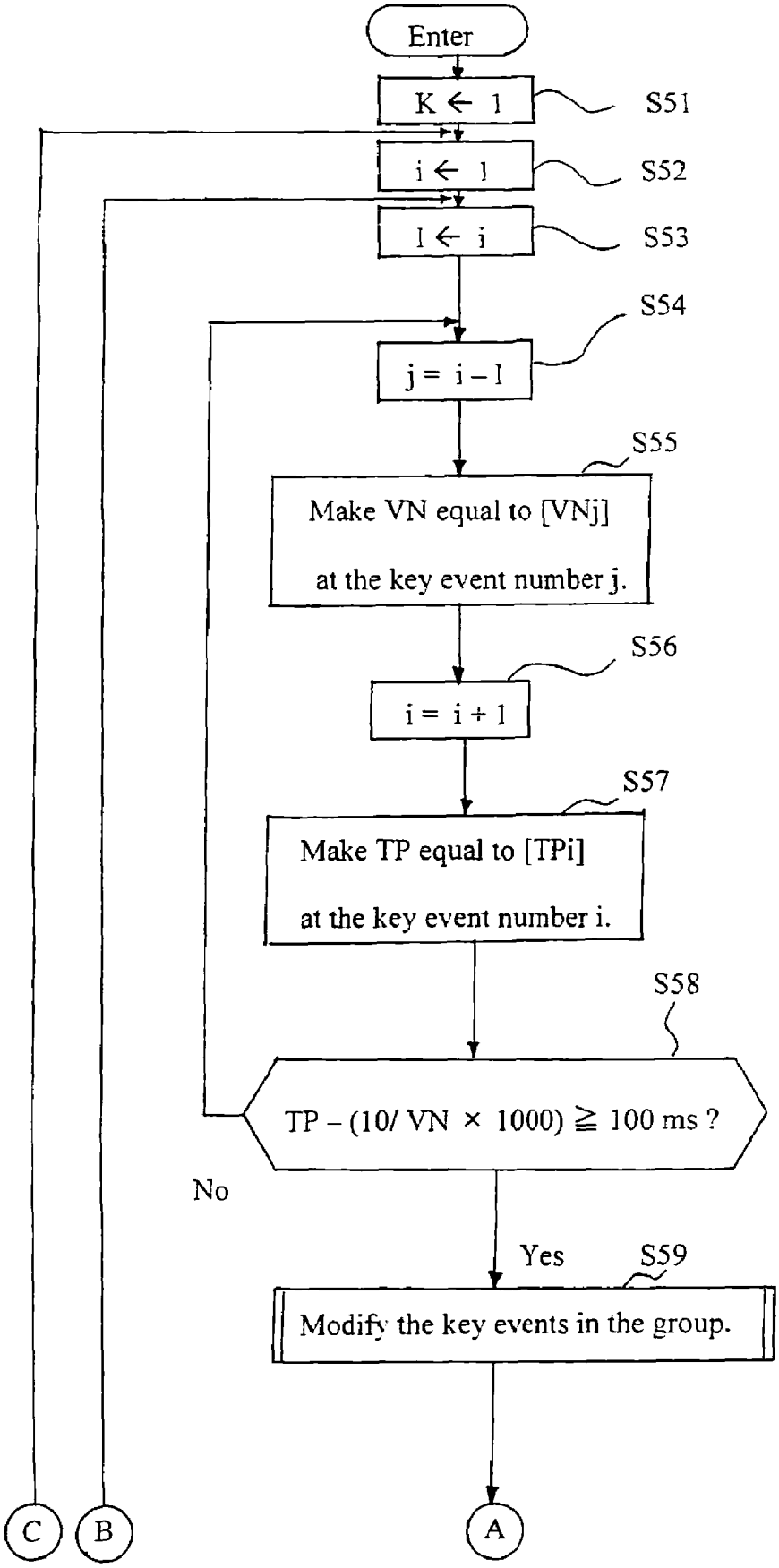
FIGS. 15A and 15B are flowcharts showing a job sequence for forming groups of reference key trajectories.
Figure 15B:
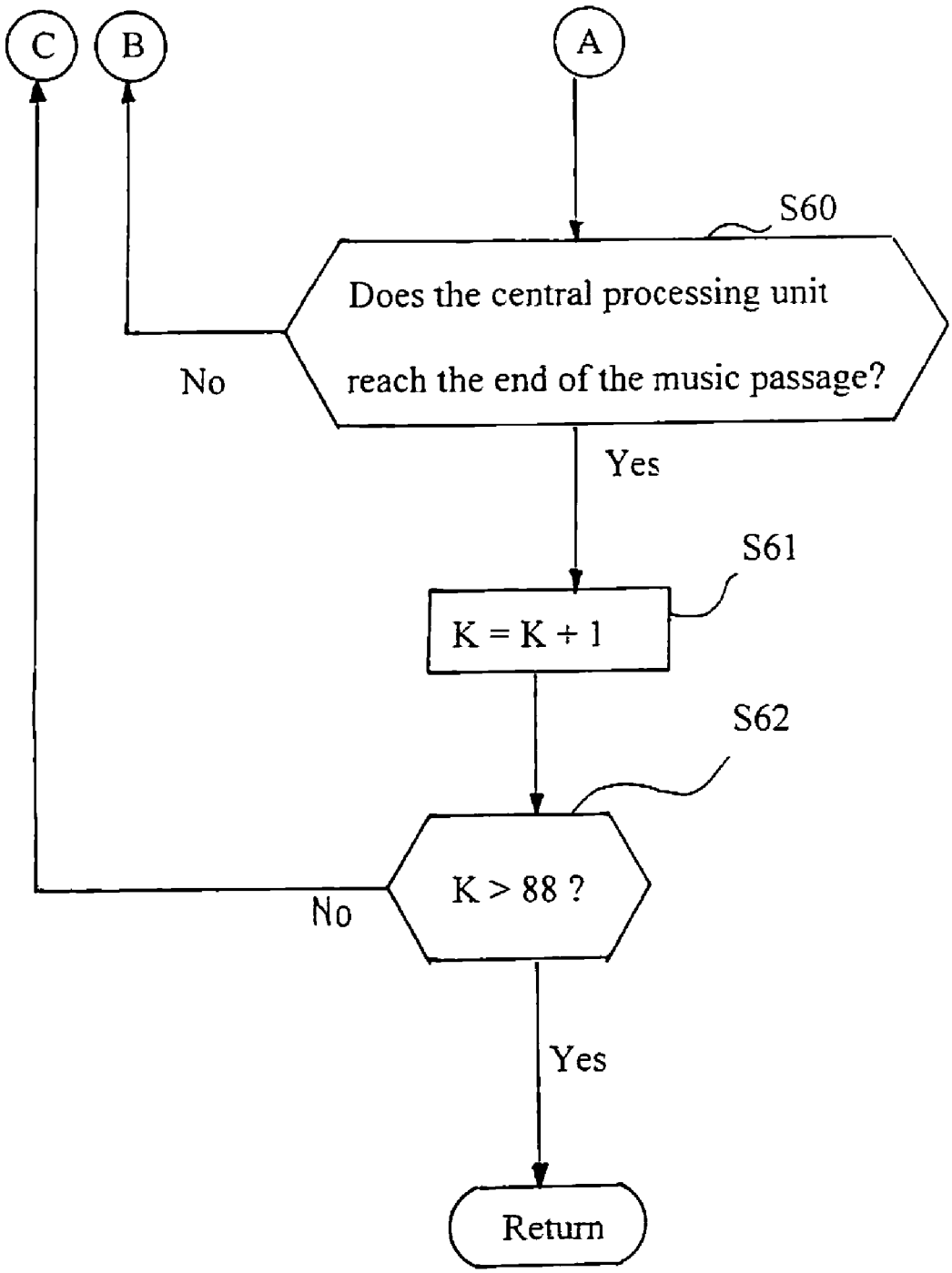

FIGS. 15A and 15B show a job sequence for grouping the reference key trajectories at step S45. The central processing unit 20 writes "1" into an index K, which expresses the key number" as by step S51, and further writes "1" into an index i expressing the key event as by step S52. The central processing unit 20 makes an index I equal to the index i as by step S53. The index I is indicative of the key event number at the head of a possible group of reference key trajectories.

The central processing unit 20 subtracts the value of index I from the value of index i, and makes an index j equal to the difference of "i−I" as by step S54. The index j is indicative of the position of the key event in the group of reference key trajectories.

Subsequently, the central processing unit 20 reads out the reference backward key velocity VNj at the key event j from the reference key trajectory data block RTK assigned to the black/white key K, and makes a variable VN equal to the reference backward key velocity VNj as by step S55.

The central processing unit 20 increments the index i by 1 as by step S56. As a result, the index i is indicative of the next key event. The central processing unit 20 reads out the lapse of time "TPi" from the reference key trajectory data block RTK, and makes a variable TP equal to the lapse of time TPi as by step S57. The lapse of time TPi is measured from the time at which the black/white key 1b/1c passes the intermediate point XM on the previous reference backward key trajectory to the time at which the black/white key 1b/1c reaches the end position XE on the reference forward key trajectory.

Subsequently, the central processing unit 20 calculates (TP−10/VN×1000), and compares the calculation result with a predetermined time period to see whether or not the calculation result is equal to or longer than the predetermined time period as by S58. The calculation result of (TP−10/VN×1000) expresses a lapse of time between the arrival at the rest position and the start toward the end position. i.e., a time period over which the black key 1b or white key 1c stays at the rest position. In this instance, the predetermined time period is 100 milliseconds, and is stored in the read only memory 21.

If the key events form a part of repetition, the calculation result is shorter than 100 milliseconds, and the answer at step S58 is given negative "No". With the negative answer "No", the central processing unit 20 returns to step S54, and examines the reference key trajectory at the next key event in the group of reference key trajectory data block RTK. The central processing unit 20 reiterates the loop consisting of steps S54 to S58 so as to find a group of reference key trajectories.

If the calculation result is equal to or longer than 100 milliseconds, the full-stroke key movement is expressed by the reference key trajectory, and the answer at step S58 is given affirmative "Yes". With the positive answer "Yes", the central processing unit 20 proceeds to step S59, and modifies the lapse of time TPi, reference forward key velocity VPi, lapse of time TNi and reference forward key velocity VNi in the group of reference key trajectories as will be described in more detail with reference to FIG. 16. In case where index i is equal to M, the central processing unit 20 unconditionally proceeds to step S59.

Upon completion of the job at step S59, the central processing unit 20 checks the reference key trajectory data block RTK labeled with the key number K to see whether or not all the reference key trajectories have been already examined as by step S60.

If at least one music data code remains unexamined, the answer at step S60 is given negative "No", and the central processing unit 20 returns to step S53 so as to make the index I equal to the index i. In other words, the key event number at the head of a possible group of key events is changed. The central processing unit 20 reiterates the loop consisting of steps S53 to S58 in order to find another group of reference key trajectories. If the central processing unit 20 finds another group of reference key trajectories, the central processing unit 20 modifies the reference key trajectories in another group at step S59, and checks the reference key trajectory data block RTK to see whether or not all the reference key trajectories have been already examined at step S60.

When the index i is equal to M, the answer at step S60 is changed to affirmative "Yes", and the central processing unit 20 increments the index K by one as by step S61. Subsequently, the central processing unit 20 checks the index K to see whether or not all the key event blocks K1 to K88 have been examined as by step S62. While the index K is being found from 1 to 88, the central processing unit 20 returns to step S52, and reiterates the loop consisting of steps S52 to S62 so as to find a group of reference key trajectories or groups of reference key trajectories for the black and white keys 1*b*/1*c*.

Upon completion of the examination on the reference key trajectory data block RT88, the answer at step S62 is changed to affirmative "Yes", and the central processing unit 20 completes the jobs at step S45.

Figure 16:
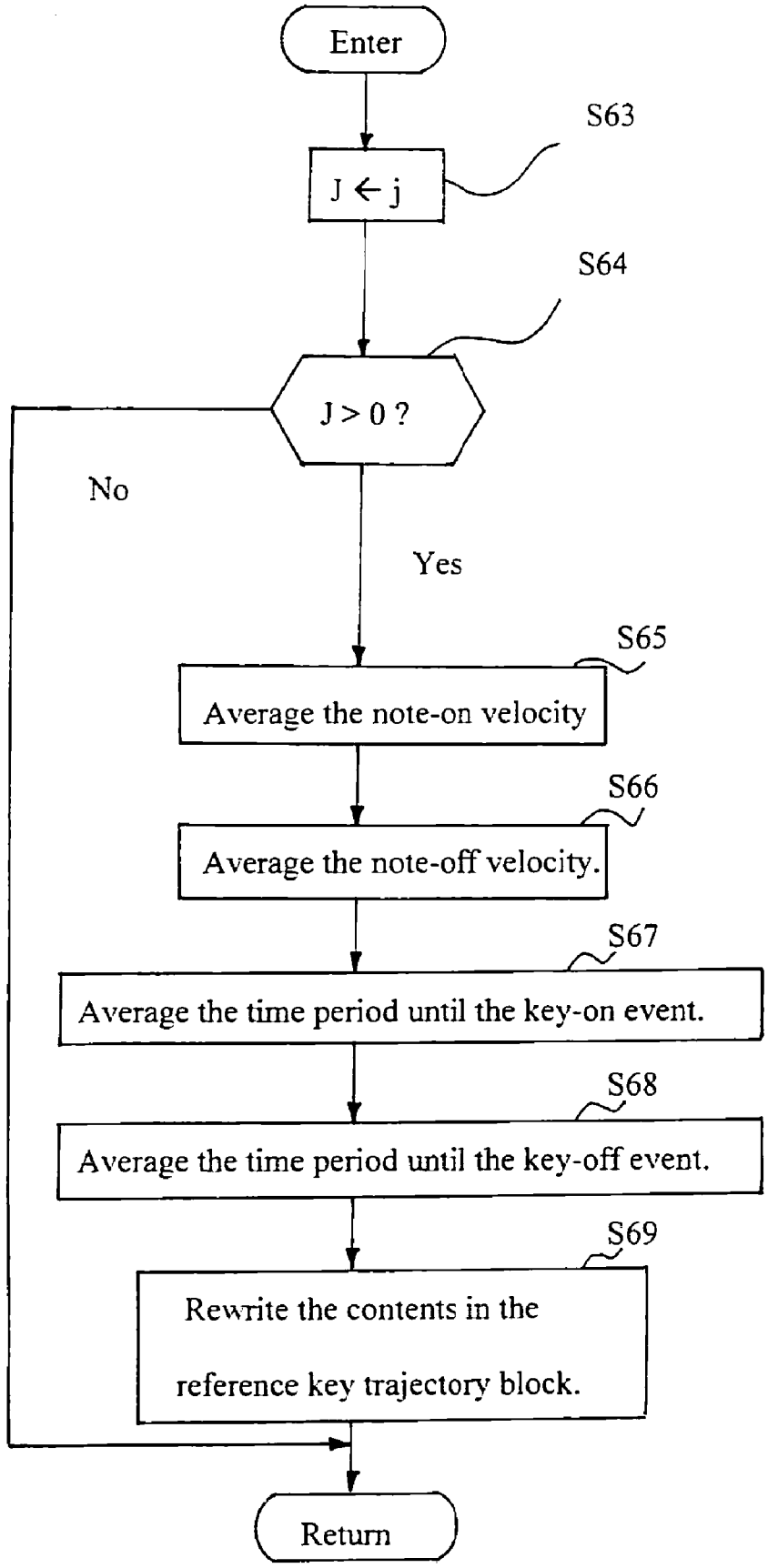
FIG. 16 is a flowchart showing a job sequence for averaging the contents of a group of reference key trajectory data.

Description is hereinafter made on the modification of reference key trajectories in a group of reference key trajectories with reference to FIG. 16. The job sequence shown in FIG. 16 is equivalent to the job at step S59. The group includes the reference key trajectories corresponding to the key event number i from index I to index (I+N), and the key event number i from index I to index (I+N) is corresponding to the key event numbers respectively assigned index j from zero to N. Variable J is indicative of the key event number j just processed as similar to the variable J in the job sequence shown in FIG. 8.

First, the central processing unit 20 makes the variable J equal to the index j as by step S63. The central processing unit 20 checks the variable J to see whether or not the number of key events in the group is greater than zero as by step S64. As described hereinbefore, the index j is varied from zero to N, and the negative answer "No" is given at step S64 on the condition that the reference key trajectory for only one key event forms the group. With the negative answer "No" at step S64, the central processing unit 20 returns to the job sequence shown in FIGS. 15A and 15B.

On the other hand, in case where the reference key trajectories for more than one key event form the group, the answer at step S64 is given affirmative "Yes". The group of reference key trajectories expresses a repetition. Then, the central processing unit 20 modifies the note-on velocity VPi, lapse of time TPi, note-off velocity VNi and relative time period TNi. In this instance, an average of the note-on velocity VPi and an average of the note-off velocity VNi are determined through a calculation for geometrical mean, and an average of the lapse of time TPi and an average of the lapse of time TNi are determined through a calculation for arithmetical mean. The pieces of reference key trajectory data to be averaged are indicated by arrow B in FIG. 12.

The central processing unit 20 determines an average VPav of the note-on velocity VPj at step S65 by using Equation 9.

$$VPav = \left\{ \prod_{J=0}^{J} (VPj) \right\}^{1/(J+1)} \quad \text{Equation 9}$$

The central processing unit 20 determines an average VNav of the note-off velocity VNj at step S66 by using Equation 10. The index j is varied from zero to J.

$$VNav = \left\{ \prod_{J=0}^{J} (VNj) \right\}^{1/(J+1)} \quad \text{Equation 10}$$

Subsequently, the central processing unit 20 determines an average of the lapse of time TPj as by step S67. The index j is varied from 1 to J so that the first lapse of time TP0 in the group is maintained. In other words, the central processing unit 20 does not change the lapse of time from the last reference key trajectory in the previous to the first reference key trajectory at the head of the. The average TPav is expressed as follows.

$$TPav = \sum_{J=1}^{J} (TPj)/(J) \quad \text{Equation 11}$$

Finally, the central processing unit 20 determines an average of the lapse of time TNj as by step S68. Since the index j is varied from zero to (J−1), the central processing unit 20 maintains the lapse of time from the last reference key trajectory to the first reference key trajectory in the next group. The average TNav is expressed as follows.

$$tnav = \sum_{J=0}^{J-1} (TNj)/(J) \quad \text{Equation 12}$$

Thus, the central processing unit 20 determines the average note-on velocity VPav, average note-off velocity VNav, average lapse of time TPav and average lapse of time TNav without changing the relative relation to the previous group and the next group.

Subsequently, the central processing unit 20 replaces all of the note-on velocity VP0 to VPJ, all of the note-off velocity VN0 to VNJ, lapse of time TP1 to TPJ and lapse of time TN0 to TNJ−1 with the average note-on velocity VPav, average note-off velocity VNav, average lapse of time TPav and average lapse of time TNav as by step S69. The central processing unit 20 remains the first lapse of time TP0 and the last lapse of time TNJ unchanged.

After the execution at step S69, the central processing unit 20 proceeds to step S60, and the jobs at steps S63 to S69 are repeated for all of the black and white keys 1*b*/1*c*.

As will be understood from the foregoing description, the motion controller 11 searches the reference key trajectory data blocks RT1 to RT88 for a group or groups of reference key trajectories expressing the repetition, and averages the pieces of reference key trajectory data in the group or each group. Even if a player depresses and releases a black/white key within an extremely short time period during the repetition, the key movement becomes mild through the averaging. In other words, the motion controller makes the key movements uniform. As a result, the servo controller 12 forces the black and white keys exactly to travel on the reference key trajectories.

Although particular embodiments of the present invention have been shown and described, it will be apparent to those skilled in the art that various changes and modifications may be made without departing from the spirit and scope of the present invention.

A velocity sensor or an acceleration sensor may be used as the key sensors. Since each of the position, velocity and acceleration is convertible to the other physical quantity, the position transducer and velocity sensors do not set any limit to the technical scope of the present invention.

The central processing unit 20 may check the reference forward key trajectory and reference backward key trajectory to see whether or not the key is released on the way to the end position or depressed on the way to the rest position. When the answer is given affirmative, the central processing unit 20 forces the key to change the direction of movement at the crossing time between the reference forward key trajectory and the reference backward key trajectory.

The uniform motion does not set any limit to the technical scope of the present invention. The black keys 1*b* and white keys 1*c* may take uniformly accelerating motion, composite motion between the uniform motion and the uniformly accelerating motion or motion expressed by a certain curve.

500 milliseconds and 100 milliseconds do not set any limit to the technical scope of the present invention. The predetermined time period is dependent on the promptness of the keyboard 1*a* and associated key action units 2. The predetermined time period may be shorter than or longer than 500 milliseconds or 100 milliseconds in other models of piano.

The lapse of time between the last key event in the previous group and the first key event is used as a criterion for a group or groups of key events in the first embodiment as shown in FIGS. 7A and 7B, and a group of reference key trajectories is formed with reference to the lapse of time after the return to the rest position in the second embodiment as shown in FIGS. 15A and 15B. Another criterion may be employed for forming a group or groups of the key events and a group or groups of reference key trajectories. For example, the repetition may be discriminated from a single full stroke key movement to see whether or not the lapse of time tni between the key-on event and the key-off event. The lapse of time tni may be a second. In the case where the reference key trajectories are examined, a lapse of time, which is equivalent to the lapse of time between the key-on event and the key-off event, serves as the criterion. Yet another criterion may be a difference in note-on velocity between a key-on event vpi and the next key-on event vp(i+1). As described in conjunction with the MIDI protocols, the velocity has 128 grades. If the loudness is expressed in accordance with the MIDI protocols, the critical difference of note-on velocity may be the thirty-second grade. Otherwise, when a difference in a note-on velocity vpi and the note-off velocity vni is greater than 16 grades, the central processing unit 20 may decide that a new group is to start. More than one criterion may be employed. In case where the reference key trajectories are examined, the central processing unit may judge the repletion by a crossing point between a reference forward key velocity and the associated reference backward key trajectory, i.e., whether or not the reference forward key trajectory crosses the reference backward key trajectory before the key reaches the rest position or end position. Otherwise, whether or not the lapse of time at the rest position/end position is shorter than 100 milliseconds may be employed as still another criterion.

A group of key events or a group of reference key trajectories may be divided into plural sub-groups at intervals of a predetermined time such as, for example, 2 seconds. A predetermined number of key events in repetition or a predetermined number of reference key trajectories in repetition may form a sub-group so as to be made the key events or reference key trajectories uniform. The predetermined number may be of the order of 10 or less than 10.

TPi and TNi may be indicative of a lapse of time between the arrival at the rest position/end position and the arrival at the end position/rest position in FIG. 14.

Although the key events or reference key trajectories are modified through the average on the timing tpi/TPi, note-on velocity vpi/VPi, timing tni/TNi and note-off velocity vni/VNi in the above-described embodiments, the key events or reference key trajectories may be modified from the view point of a mean frequency of key depressing. In this instance, when the mean frequency of key depressing is found to exceed the critical frequency such as 8 Hz in upright pianos, the means frequency is replaced with the critical frequency, and the key events are modified on the assumption that the black key 1*b* or white key 1*c* is depressed at the critical frequency. Some key events may be omitted from the group of key events or group of reference key trajectories during the modification. However, the time at which the first note-on key event takes place and the time at which the last note-off key event takes place are not changed so as to keep the continuity of key events at the boundaries.

In yet another modification, the key events may be analyzed through a regression analysis on the basis of a linear model or a nonlinear model so as to be modified in accordance with the linear model or non-linear model as shown in FIGS. 9 and 12. In the example shown in FIG. 9, the note-on velocity is increased during the repetition, and the relative time period is shortened. The tendencies are maintained after the modification by using the linear model.

In still another modification, the pieces of music data or pieces of reference key trajectory data may be modified by keeping a standard deviation. For example, the pieces of music data or pieces of reference key trajectory data are modified with random numbers so that fluctuation is introduced into the note-on velocity. However, the standard deviation is maintained in the pieces of music data or pieces of reference key trajectory data. The key events keep the tendency in the original performance.

The pieces of reference key trajectory data may be partially replaced with other pieces of reference key trajectory data on the assumption that the key is changed from the uniform motion through uniform acceleration motion to the uniform motion. The sort of motion may be determined after the analysis on the pieces of reference trajectory data.

When the key movements are averaged, the keystroke toward the end position may be modified, or the keystroke toward the rest position may be modified.

More than one of the above-described modifications may be employed in an automatic player musical instrument. The controlling unit 91 may offer a menu of objects to be modified to a user through a display. When the user specifies the object or objects, the controlling unit 91 modifies the selected object or objects on the basis of the analysis on the pieces of music data or pieces of reference key trajectory data.

The user may prioritize the objects. When the controlling unit 91 finds that further modification on remaining objects makes the artificial expression through the musical passage, the controlling unit 91 stops the modification.

The sort of musical instrument used in recording may be stored in the music data file. In this instance, the data modification is carried out on the condition that the sort of musical instrument used in recording is different from the sort of musical instrument used in playback. In case where the standard MIDI file is employed, the sort of musical instrument used in recording is memorized in the header in the form of an identification code. The central processing unit 20 may judge the sort of musical instrument prior to the jobs at step S3 or S42.

To modify the pieces of music data or not to modify them may be dependent on user's intention.

The central processing unit 20 may start the jobs at step S4 or step S43 before completion of the data transfer to the random access memory 22. In this instance, the jobs at step S4 or step S43 are carried out in parallel to the data transfer to the random access memory 22.

A suitable data buffer may be provided between a data source and the random access memory 22 so as to introduce delay time into the data transmission. The delay time may be 500 milliseconds. In this instance, the central processing unit 20 carries out the jobs at step S4 or step S43 on the pieces of music data stored in the data buffer. In this instance, the pieces of music data, which are produced in another musical instrument or a personal computer system, are processed as if the playback proceeds in a real time fashion.

The note-off velocity may be expressed by using the note-on velocity. When the note-on velocity is zero the note-on data code expresses the note-off event. In this instance, the central processing unit may presume the note-off velocity for determining the reference backward key trajectory. After the determination, the central processing unit 20 forms a group/groups of key events or a group/groups of reference key trajectories, and modifies them, if necessary.

The configuration of servo controlling loop shown in FIG. 11 does not set any limit to the technical scope of the present invention. Another servo controlling loop may carry out on one of or more than one physical quantity such as, for example, position, velocity, acceleration, force and so forth. A constant, which expresses a bias current, may be further added to the sum u of products.

The upright piano 1 does not set any limit to the technical scope of the present invention. The present invention appertains to an automatic player piano fabricated on the basis of a group piano, a hybrid musical instrument such as, for example, a mute piano and an electronic keyboard. An automatic player musical instrument may be fabricated on the basis of another sort of musical instrument such as, for example, a celesta or a wind musical instrument in so far as the musical instrument has plural manipulators for specifying the tones to be produced.

The central processing unit 20 and other peripheral electronic circuits may be implemented by a single-chip microcomputer, a single-chip microprocessor or another sort of semiconductor device with the data processing capability. A part of the computer program may be replaced with a wired-logic circuit, and a digital signal processor is available for certain jobs.

The central processing unit 20 may determine a repetition through a judgment on the key numbers in the note-on event codes and note-off event codes. If the note-on events of a key and the note-of events of the key are continued, the central processing unit 20 determines that the key is repeatedly depressed and released.

The central processing unit 20 may compare the note-on event code and note-off event code to see whether or not the relative time period exhibits a repetition without sorting. i.e., the jobs at steps S13 to S15. In this instance, the central processing unit 20 focuses the attention to one of the key numbers for comparing the relative time period with the threshold without consideration of the other key numbers, and the comparison is repeated for other key numbers.

The central processing unit 20 may make either note-on velocity/note-off velocity vpj/VPj/and vnj/VNj or relative time period tpj/TPj and tnj/TNj uniform.

The automatic playing system 10 may be offered to users. In this instance, the users retrofit their acoustic pianos to the automatic player pianos through installation of the automatic playing system 10 into the acoustic pianos. Otherwise, the automatic playing system 10 may be offered to users as a physically independent unit. In this instance, the automatic playing system 10 is combinable with various models of acoustic pianos before the automatic playing.

The component parts of the automatic player pianos and jobs achieved through the execution of the computer programs are correlated with claim languages as follows.

The automatic player piano is corresponding to an "automatic player musical instrument", and the upright piano 1 serves as a "musical instruments". The black keys 1*b* and white keys 1*c* are corresponding to "plural manipulators", and the action units 2, hammers 3, strings 4 and dampers 39 as a whole constitute a "tone generator". The central processing unit 20, read only memory 21, random access memory 22 and jobs at steps S16 to S22 and S24 to S26 or the central processing unit 20, read only memory 2 random access memory 22 and jobs at steps S51 to S58 and S60 to S62 as a whole constitute a "searcher". The central processing unit 20, read only memory 21, random access memory 22 and jobs at steps S27 to S33 or the central processing unit 20, read only memory 21, random access memory 22 and jobs at steps S63 to S69 as a whole constitute a "modifier". The key sensors 6, plunger sensors 8, pulse width modulator 26, central processing unit 20, read only memory 21, random access memory 22 and jobs at steps S2 and S7 to S11 as a whole constitute a "signal regulator".

The note-on velocity vpj or VPj, note-off velocity vnj or VNj, relative time period tpj or TPj and relative time period tnj or TNj are "properties of tone producing events". The pieces of music data expressing the note-on velocity vpi, note-off velocity vni, relative time period tpi and relative time period tni or pieces of reference key trajectory data serve as "pieces of event data".

The memory location in the read only memory 21 assigned to the predetermined time period 500 milliseconds or 100 millisecond serves as a "threshold holder", and 500 milliseconds or 100 milliseconds is a "threshold". The relative time period "tpi" or the lapse of time over which the black key 1*b* or white key 1*c* stays at the rest position, i.e., the calculation result (TP−(10/VN×1000)) serves as a "certain property". The central processing unit 20, read only memory 21, random access memory 22 and jobs at steps S13 to S15 and S16 to S26 as a whole constitute a "comparator".

The central processing unit 20, read only memory 21, random access memory 22 and jobs at steps S13 to S14 as a whole constitute a "sorter", and the central processing unit 20, read only memory 21, random access memory 22 and jobs at steps S16 to S26 as a whole constitute a "discriminator".

The central processing unit 20, read only memory 21, random access memory 22 and jobs at step S44 as a whole constitute a "data generator". The central processing unit 20, read only memory 21, random access memory 22 and jobs at step S45 as a whole constitute a "sorter", and the central processing unit 20, read only memory 21, random access memory 22 and jobs at steps S51 to S62 as a whole constitute a "discriminator". The keystroke from the rest position and the reference point is, by way of example, contained in "pieces of experimental data", and constants α, β, γ and δ also serve as the "pieces of experimental data".

What is claimed is:

1. An automatic player musical instrument for producing tones along a music passage having a repetition, comprising:

a musical instrument including plural manipulators selectively moved for specifying the tones to be produced, and a tone generator connected to said plural manipulators and producing said tones specified by means of the manipulators moved for said tones; and an automatic playing system including plural actuators provided in association with said plural manipulators and responsive to a driving signal so as to move the associated manipulators for specifying said tones, and a controlling unit connected to said plural actuators for selectively supplying said driving signal to said plural actuators, a computer program running on said controlling unit so as to realize a plurality of functions including a searcher searching a set of pieces of music data expressing properties of tones to be produced in a music passage for certain tone producing events determined on the basis of certain pieces of music data in said set and expressing the tones to be produced in at least one repetition on one of said plural manipulators, a modifier connected to said searcher and modifying certain pieces of event data produced on the basis of said certain pieces of music data and expressing properties of said certain tone producing events so as to make at least one of said properties of said certain tone producing events uniform and a signal regulator connected to said modifier and regulating said driving signal to an optimum magnitude on the basis of said certain pieces of event data already modified so as to cause said tone generator to produce the tones in said at least one repetition through the movements of said manipulators on the condition that said at least one of said properties of said certain tone producing events is uniform.

2. The automatic player musical instrument as set forth in claim 1, in which said searcher includes sub-functions realized through execution of said computer program. wherein said sub-functions of said searcher are a threshold reader reading out a threshold of a certain property of said certain tone producing events from a data storage, and a comparator connected to said threshold reader and comparing said certain property of tone producing events determined on the basis of said pieces of music data of said set with said threshold to see whether or not each of said tone producing events serves as one of said certain tone producing events.

3. The automatic player musical instrument as set forth in claim 2, in which said comparator sub-functions realized through execution of said computer program, wherein said sub-functions of said comparator are a sorter sorting said pieces of music data to index numbers assigned to said plural manipulators and producing pieces of event data on the basis of said pieces of music data of said set so as selectively store said pieces of event data into data blocks respectively assigned to said plural manipulators, and a discriminator successively reading out said pieces of event data from each of said data blocks and discriminating said certain pieces of event data expressing said certain tone producing events in said at least one repetition from other pieces of event data expressing the tone producing events of other styles of rendition through the comparison with said threshold.

4. The automatic player musical instrument as set forth in claim 2, in which said certain property is a lapse of time from a time at which each of said plural manipulators changes a direction of movement to a time at which said each of said plural manipulators changes said direction of movement, again.

5. The automatic player musical instrument as set forth in claim 2, in which said certain property is a lapse of time over which each of said plural manipulators stops at a certain point at which said each of said plural manipulators changes a direction of the movement.

6. The automatic player musical instrument as set forth in claim 2, in which said comparator includes sub-function realized through said execution of said computer program. wherein said sub-functions of said comparator are a data generator determining pieces of reference trajectory data expressing target trajectories for each of said plural manipulators on the basis of said pieces of music data and pieces of experimental data used in the determination of said Pieces of reference trajectory data, a sorter sorting said pieces of reference trajectory data to index numbers respectively assigned to said plural manipulators and preparing the pieces of event data from said pieces of reference trajectory data so as selectively store said pieces of event data into data blocks respectively assigned to said plural manipulators, and a discriminator successively reading out said pieces of event data from each of said data blocks and discriminating said certain pieces of event data expressing said certain tone producing events of said at least one repetition from other pieces of event data expressing the tone producing events of other styles of rendition through the comparison with said threshold.

7. The automatic player musical instrument as set forth in claim 1, in which said musical instrument is a piano having black keys and white keys serving as said plural manipulators.

8. The automatic player musical instrument as set forth in claim 7, in which said black keys and said white keys are connected to dampers and action units for driving hammers to strike strings at an end of rotation, and said dampers, said action units, said hammers and said strings serve as said tone generator.

9. The automatic player musical instrument as set forth in claim 1, in which a part of said computer program running on said controlling unit and said plural actuators form a servo control loop together with sensors monitoring said plural manipulators.

10. The automatic player musical instrument as set forth in claim 9, in which said sensors indirectly monitors said plural manipulators through the movements of movable portions of said plural actuators.

11. The automatic player musical instrument as set forth in claim 10, further comprising other sensors directly monitoring said plural manipulators.

12. An automatic playing system for performing a music passage on a musical instrument, comprising:

plural actuators provided in association with plural manipulators of said musical instrument, and responsive to a driving signal so as to move the associated manipulators for specifying tones to be produced by means of a tone generator of said musical instrument connected to said plural manipulators; and a controlling unit connected to said plural actuators for selectively supplying said driving signal to said plural actuators, a computer program running on said controlling unit so as to realize a plurality of functions including a searcher searching a set of pieces of music data expressing properties of tones to be produced in a music passage for certain tone producing events determined on the basis of certain pieces of music data in said set and expressing the tones to be produced in at least one repetition on one of said plural manipulators, a modifier connected to said searcher and modifying certain pieces of event data produced on the basis of said certain pieces of music data and expressing properties of said certain tone producing events so as to make at least one of said properties of said certain tone producing events uniform and a signal regulator connected to said modifier and regulating said driving signal to an optimum magnitude on the basis of said certain pieces of event data already modified so as to cause said tone generator to produce the tones in said at least one repetition through the movements of said manipulators on the condition that said at least one of said properties of said certain tone producing events is uniform.

13. The automatic playing system as set forth in claim 12, in which said searcher includes sub-functions realized through execution of said computer program, wherein said sub-functions of said searcher are a threshold reader reading out a threshold of a certain property of said certain tone producing events from a data storage, and a comparator connected to said threshold reader and comparing said certain property of tone producing events determined on the basis of said pieces of music data of said set with said threshold to see whether or not each of said tone producing events serves as one of said certain tone producing events.

14. The automatic playing system as set forth in claim 13, in which said comparator sub-functions realized through execution of said computer program, wherein said sub-functions of said comparator are a sorter sorting said pieces of music data to index numbers assigned to said plural manipulators and producing pieces of event data on the basis of said pieces of music data of said set so as selectively store said pieces of event data into data blocks respectively assigned to said plural manipulators, and a discriminator successively reading out said pieces of event data from each of said data blocks and discriminating said certain pieces of event data expressing said certain tone producing events in said at least one repetition from other pieces of event data expressing the tone producing events of other styles of rendition through the comparison with said threshold.

15. The automatic playing system as set forth in claim 13, in which said certain property is a lapse of time from a time at which each of said plural manipulators changes a direction of movement to a time at which said each of said plural manipulators changes said direction of movement, again.

16. The automatic playing system as set forth in claim 13, in which said certain property is a lapse of time over which each of said plural manipulators stops at a certain point at which said each of said plural manipulators changes a direction of the movement.

17. The automatic playing system as set forth in claim 13, in which said comparator includes sub-function realized through said execution of said computer program, wherein said sub-functions of said comparator are a data generator determining pieces of reference trajectory data expressing target trajectories for each of said plural manipulators on the basis of said pieces of music data and pieces of experimental data used in the determination of said pieces of reference trajectory data, a sorter sorting said pieces of reference trajectory data to index numbers respectively assigned to said plural manipulators and preparing the pieces of event data from said pieces of reference trajectory data so as selectively store said pieces of event data into data blocks respectively assigned to said plural manipulators, and a discriminator successively reading out said pieces of event data from each of said data blocks and discriminating said certain pieces of event data expressing said certain tone producing events of said at least one repetition from other pieces of event data expressing the tone producing events of other styles of rendition through the comparison with said threshold.

18. The automatic playing system as set forth in claim 12, in which said plural actuators and said controlling unit form a servo control loop together with sensors monitoring said plural manipulators.

19. The automatic playing system as set forth in claim 18, in which said sensors indirectly monitors said plural manipulators through the movements of movable portions of said plural actuators.

20. The automatic playing system as set forth in claim 19, further comprising other sensors directly monitoring said plural manipulators.

* * * * *